US006614412B1

(12) United States Patent
Hirano et al.

(10) Patent No.: US 6,614,412 B1
(45) Date of Patent: Sep. 2, 2003

(54) APPARATUS, MANUFACTURING METHOD AND DRIVING METHOD OF PLASMA DISPLAY PANEL

(75) Inventors: Naoto Hirano, Tokyo (JP); Keiji Nunomura, Tokyo (JP)

(73) Assignee: NEC Corporation (JP)

( * ) Notice: Subject to any disclaimer, the term of this patent is extended or adjusted under 35 U.S.C. 154(b) by 311 days.

(21) Appl. No.: 09/650,196

(22) Filed: Aug. 29, 2000

(30) Foreign Application Priority Data

Sep. 1, 1999 (JP) ..... 11-248039

(51) Int. Cl.[7] ..... G09G 3/28
(52) U.S. Cl. ..... 345/60; 313/484
(58) Field of Search ..... 345/60, 65, 66; 313/484, 586, 587, 485; 438/239, 244, 253, 200, 957

(56) References Cited

U.S. PATENT DOCUMENTS

| | | | | |
|---|---|---|---|---|
| 6,255,780 B1 | * | 7/2001 | Komaki et al. | 313/586 |
| 6,426,250 B1 | * | 7/2002 | Lee et al. | 438/239 |

FOREIGN PATENT DOCUMENTS

| | | | | |
|---|---|---|---|---|
| JP | 1-274339 | | 11/1989 | H10J/17/49 |
| JP | 3-219286 | * | 9/1991 | |
| JP | 4-181633 | * | 6/1992 | H01J/11/00 |
| JP | 0436535 | * | 10/1992 | |
| JP | 044306535 | | 10/1992 | H01J/11/00 |
| JP | 08007770 | | 1/1996 | H01J/11/00 |
| JP | 8-138558 | * | 5/1996 | H01J/11/02 |
| JP | 0800770 | * | 12/1996 | |
| JP | 2709248 | * | 10/1997 | |
| JP | 10-074458 | * | 3/1998 | H01J/17/16 |
| KR | 1999-62632 | | 7/1999 | H10J/17/00 |
| WO | WO98/12728 | * | 3/1998 | H01J/11/00 |
| WO | WO 01/91156 | * | 11/2001 | H01J/17/00 |

* cited by examiner

*Primary Examiner*—Amare Mengistu
(74) *Attorney, Agent, or Firm*—Hayes Soloway P.C.

(57) ABSTRACT

To provide a plasma display panel which improves the write characteristics, luminous luminance, and luminous efficiency and which has a longer life. On a back glass substrate, data electrodes are formed in the substrate column direction. Over the data electrodes, a dielectric layer is formed. On the dielectric layer, scan electrodes are formed in a substrate row direction. Over the scan electrodes, a dielectric layer is formed. On the dielectric layer, partitions are formed in the substrate column direction. On the dielectric layer including the partitions, a protection layer and a fluorescent material layer are formed. On the other hand, on a front glass substrate, common electrodes and bus electrodes electrically connected to the common electrodes are formed in the substrate row direction so as to be opposed to the scan electrodes. Over the common electrodes and the bus electrodes, a dielectric layer and a protection layer are formed.

41 Claims, 17 Drawing Sheets

FIG. 6

| | A | B | C | D | E |
|---|---|---|---|---|---|
| WRITE DISCHARGE | PLANAR DISCHARGE | VERTICAL DISCHARGE | PLANAR DISCHARGE | VERTICAL DISCHARGE | PLANAR DISCHARGE |
| SUSTAINING DISCHARGE | PLANAR DISCHARGE | VERTICAL DISCHARGE | PLANAR DISCHARGE | PLANAR DISCHARGE | VERTICAL DISCHARGE |
| ELECTRODE ARRANGEMENT | + | | ++ | | + |

FIG. 7

| | A | B | C | D | E |
|---|---|---|---|---|---|
| DRIVE CHARACTERISTICS | × | × | △ | △ | ○ |
| LUMINANCE·EFFICIENCY | × | △ | △ | ○ | ◎ |
| POWER CONSUMPTION | × | △ | △ | ○ | ◎ |
| LIFE | × | ○ | × | △ | ○ |
| LARGER AREA | △ | △ | △ | △ | ○ |
| HIGHER DIFINITION | △ | △ | △ | △ | ○ |

×:INFERIOR △:SLIGHTLY INFERIOR ○:SUPERIOR ◎:FAR SUPERIOR

APPARATUS, MANUFACTURING METHOD AND DRIVING METHOD OF PLASMA DISPLAY PANEL

BACKGROUND OF THE INVENTION

1. Technical Field of the Invention

The present invention relates to a plasma display panel (PDP), and in particular to a panel structure, its manufacturing method, its drive method, and its drive device which makes possible low voltage drive and fast writing, and which can achieve high luminance, a high efficiency, and a longer life.

2. Description of the Prior Art

In PDP, electrons accelerated by an electric field collide with gas atoms or molecules and ultraviolet light generated by the collision is converted to visible light by fluorescent materials to display color images. PDP is one of the flat panel display apparatuses with large area and large capacity. Conventional PDP is explained, referring to FIGS. 15 to 18. In these figures, the portions relating to various electrodes are mainly illustrated.

In a structure shown in FIG. 15, data electrode 2 is formed in a column direction on back glass substrate 1. On data electrode 2, dielectric layer 3 is formed. On the dielectric layer 3, scan electrode 4 is formed in a row direction. On scan electrode 4, dielectric layer 5 is formed. In a portion where the electrodes cross with each other, a unit cell for pixel is formed. In a PDP having such a structure, write discharge 21 (planar discharge) for selecting a cell for the display occurs at the intersection of data electrode 2 and scan electrode 4 formed on substrate 1, and thereafter sustaining discharge 22 (planar discharge) for emitting visible light occurs. Such a structure is called cross planar discharge type, and has a feature that the electrodes are formed only on a substrate, unlike a cross vertical discharge type shown in FIG. 16.

In this structure, however, write discharge 21 and sustaining discharge 22 are generated at the same place. Therefore, the high energy ions attack a not-shown protection layer at the time of the discharges. Therefore, ion impact due to write discharge 21 is superposed on that of sustaining discharge 22 at the same place. This results in a problem of a short operation life, due to degradation of the protection layer. Unlike the case of the vertical discharge described later, especially in the case of the planar discharge, the distortion of the electric field (concentration of electric lines of force 17) at the electrode edge portion is great, high energy ions concentrate in the protection layer located near the electrode edge portion, and ions are incident obliquely on the protection layer. In the case of the planar discharge, therefore, damage of the protection layer caused by the ion impact becomes more severe. Furthermore, there is also a problem of a low luminance and a low conversion efficiency from the electric power to the luminance, because the discharge region is narrow. Furthermore, there is also a problem of complicated driving sequence and a complicated drive circuit, because the electrode pair causing write discharge 21 and sustaining discharge 22 lies at the same place. Further, in general, PDP is a distributed parameter circuit, due to the resistances and capacitances of the electrodes. Therefore, the peak values of sustaining pulse 20 vary, depending upon the location of the display panel. Concretely, the luminance at the connection portion with an external drive circuit is different from that at the position remote from the connection portion. This variation of the peak values destroys the uniformity in luminance in the displayed pictures. The luck of uniformity in the pictures becomes serious, as the display area becomes larger, particularly in case of the AC discharge—PDP, wherein pulse discharge current is high.

On the other hand, in the structure shown in FIG. 16, data electrode 2 is formed along a column direction on a back glass substrate 1. On the data electrode 2, dielectric layer 3 is formed. On front glass substrate 10, scan electrode 4 is formed along the row direction. On scan electrode 4, dielectric layer 13 is formed. In the PDP having such a structure, write discharge 21 (vertical discharge) occurs in between data electrode 2 and scan electrode 4, and thereafter sustaining discharge 22 (vertical discharge) occurs. In this case, both write discharge 21 and sustaining discharge 22 are of the vertical discharge type. As compared with the structure shown in FIG. 15, there is an advantage that the damage of the not shown protection layer, caused by the ion impact is reduced. Furthermore, since the discharge region can be expanded by widening the distance between electrodes, there is a possibility that the luminance and the conversion efficiency from the electric power to the luminance can be improved. In this case, however, the voltage for driving the PDP becomes very high.

The structure as shown in FIG. 16 as well as the structure as shown in FIG. 15 has a problem of a shortened life caused by superposition of ion impact at the same place. The life is dependent upon the type of PDP, because each electrode is covered with a dielectric layer in the AC discharge system, while each electrode is exposed in a direct current (DC) discharge system. Furthermore, there is a problem of complicated driving sequence and a drive circuit caused by the fact that an electrode pair generates the write discharge 21 and the sustaining discharge 22. Furthermore, there is a problem that the luminance varies, depending upon the location on the display panel.

On the other hand, in the structure shown in FIG. 17, data electrode 2 is formed along a column direction on back glass substrate 1. On data electrode 2, dielectric layer 3 is formed. On dielectric layer 3, scan electrode 4 and common electrode 11 are formed in the row direction. On scan electrode 4 and common electrode 11, dielectric layer 13 is formed. In a portion where the electrodes cross with each other, a unit cell is formed. In PDP having such a structure, write discharge 21 (planar discharge) is generated in the intersection of data electrode 2 and scan electrode 4 formed on substrate 1, and thereafter sustaining discharge 22 (planar discharge) is generated between scan electrode 4 and common electrode 11. In this case, there is an advantage that the drive method and circuit are simplified, because different electrode pairs cause write discharge 21 and sustaining discharge 22. Furthermore, there is also an advantage that the life of the non-shown protection layer becomes longer than that of the structure as shown in FIGS. 15 and 16.

In the structure shown in FIG. 17, there is an advantage in the manufacturing process that all electrodes are formed on one substrate. However, there is a disadvantage that the capacitance between data electrode 2, scan electrode 4 and common electrode 11 become large and hence the driving load increases. This poses a serious problem especially in large area display panels. Furthermore, since each discharge is of the planar discharge, the problem of the shortened life caused by degradation of a protection layer not easily solved.

On the other hand, in the structure shown in FIG. 18, data electrode 2 is formed in a column direction on back glass substrate 1. On data electrode 2, dielectric layer 3 is formed. On front glass substrate 10, scan electrode 4 and common electrode 11 are formed in the row direction. On scan electrode 4 and common electrode 11, dielectric layer 13 is formed. In PDP having such a structure, write discharge 21 (vertical discharge) is generated between data electrode 2 and scan electrode 4 formed on different substrates via discharge space, and thereafter sustaining discharge 22 (planar discharge) is generated between scan electrode 4 and common electrode 11. In this case, there is an advantage that the driving method and circuit become simple, because different electrode pairs cause write discharge 21 and sustaining discharge 22. Furthermore, since data electrode 2 is formed on the back glass substrate 1 side, there is also an advantage that the capacitance between data electrode 2, scan electrode 4 and common electrode 11 can be reduced as compared with the structure shown in FIG. 17. Furthermore, since write discharge 21 is of the vertical discharge type, there is also an advantage that the damage of the non-shown protection layer caused by ion ompact is reduced as compared with the structure shown in FIG. 17. There are known two types which are of the same type as that as shown in FIG. 18, one of which is the reflection type, wherein the sustaining discharge is conducted on the front glass substrate side, and the other of which is the transmission type, wherein the sustaining discharge is conducted on the back glass substrate side. As regards the luminance, conversion efficiency and life, the reflection type is superior. In both cases, however, the AC discharge is employed.

Due to the background heretofore described, the reflection type PDP of the AC discharge system using three kinds of electrodes as shown in FIG. 18 occupies the mainstream at the present time. FIG. 19 is an oblique view showing its representative panel structure. FIG. 20 is an exploded oblique view showing a unit cell structure. By referring to FIGS. 19 and 20, the conventional technique shown in FIG. 18 will further be described.

On back glass substrate 1, data electrodes 2 made of metal or the like are formed in the substrate column direction. Over data electrode 2, dielectric layer 3 made of a metallic oxide or the like is formed. On dielectric layer 3, stripe-shaped partitions 6 made of a metallic oxide or the like are formed in substrate column direction. On dielectric layer 3 including the partition side faces, fluorescent materials layer 8 which emits light of colors of red (R), green (G), and blue (B) is formed. On the other hand, on front glass substrate 10, pairs of scan electrode 4 and common electrode 11, which are made of a metallic oxide or the like and which are transparent and conductive, are formed in the substrate row direction. Bus electrodes 12 made of metal or the like aiming at lowering the resistance are electrically connected with scan electrode 4 and common electrode 11. On scan electrode 4 and common electrode 11 including bus electrodes 12, dielectric layer 13 and a protection layer which are made of a metallic oxide or the like are deposited successively. Back glass substrate 1 and front glass substrate 10 are stuck together so as to have their structures inside. Within space thus formed, discharge gas containing noble gas or the like is let in. R, G and B in FIG. 19 represent a red color luminous unit cell, a green luminous unit cell, and a blue luminous unit cell for coloring, respectively.

As shown in FIG. 21, in the PDP having such a structure, write discharge 21 shown in FIG. 18 is caused by write pulse 19 and signal pulse 18, and sustaining discharge 22 shown in FIG. 18 is caused by sustaining pulse 20.

However, the PDP shown in FIG. 22 has the following problems.

A first problem is that the write voltage (a difference in peak value between the write pulse 18 and the signal pulse 19, in other words, the sum of respective absolute values) is high. The reason is that the write interval (an interval during which the write pulse 18 and the signal pulse 19 are applied) is short and in addition data electrode 2 is disposed at a great spatial distance from scan electrode 4. In the conventional technique, therefore, a voltage higher than the sustaining voltage (peak value of sustaining pulses 20) is needed as the write voltage. As the write time becomes shorter and the height of partition 6 becomes higher, this tendency becomes remarkable. In the conventional technique, an inexpensive low withstanding voltage circuit cannot be used as a drive circuit for applying a voltage pulse to data electrode 2 and scan electrode 4, but an expensive high withstanding voltage circuit must be used. Finally, this results in an increase of the manufacturing cost.

For lowering the write voltage, the distance between the electrodes, i.e., the height of partition 6 needs to be made small, in accordance with the Paschen's law. According to the Paschen's law, a minimum voltage, i.e., a firing voltage required for causing a firing discharge under a constant electric field and temperature is given as a function of a product of a gas pressure p and a distance d between electrodes. If the height of partition 6 is lowered, however, the discharge space becomes narrow, resulting in an evil influence of a raised sustaining voltage.

The reason will now be described. As shown in FIG. 22, electric lines of force 23 generated between scan electrode 4 and common electrode 11 are greatly curved. If the height of partition 6 is lowered, then an effective volume required to cause the sustaining discharge is reduced and the density of electric lines of force 23 is reduced. That is the reason. Such a phenomenon that readiness of occurrence of discharge is changed by the space volume or the electrode area is called volume effect or area effect. In general, as the space volume and the electrode area become greater, routes capable of being subjected to breakdown statistically increase and the discharge becomes easy to occur. If the condition is the same, therefore, the vertical discharge is easier to occur than the planar discharge.

The above described decrease of the discharge space brings about a decrease of the discharge region, in other words, a decrease of the plasma volume. Consequently, it also causes a decrease in luminance and efficiency due to a decrease in the quantity of ultraviolet light. Furthermore, since the region of sustaining discharge 22 approaches fluorescent materials layer 8, there also occurs an evil influence that fluorescent materials layer 8 is easily degraded by the impact of electrically charged particles, such as ions and electrons, generated in plasma.

A second problem is that it is difficult to shorten the write interval. The reason is that data electrode 2 is disposed at a great spatial distance from scan electrode 4 in the same way as the above described problem. As a result, the discharge probability becomes low, and it becomes difficult to cause write discharge 21 sufficiently in a short time.

As the number of pixels increases, the write interval becomes shorter. Furthermore, as the screen becomes large, the electrode length becomes longer, and consequently the pulse delay (blunting of the voltage pulse waveform) becomes large due to a voltage drop caused by a series resistance component of the electrode. With a higher definition and a larger screen, writing becomes more difficult. If write discharge 21 is made easy to occur by lowering the height of partition 6 in order to suppress this problem, other characteristics are hampered. For causing sufficient write discharge 21 uniformly over the whole panel in a limited time, therefore, the write voltage must be made higher.

A third problem is that it is difficult to improve the drive margin. The reason is that write discharge 21 is hard to occur. In other words, this problem is intensely related to the above described two problems.

Write discharge 21 is an important discharge for bringing a unit cell corresponding to the intersection of data electrode 2 supplied with signal pulse 18 and scan electrode 4 supplied with write pulse 19 at the same time into a selection state and for causing luminous display by using a subsequent sustaining discharge 22.

If write discharge 18 occurs, then wall charges are stored in the cell, and priming particles of electrons and ions (particles serving as the discharge trigger) are supplied in the cell. In the cell, a discharge is easier to occur than in cells which are not selected. In other words, in the selected cell, a discharge can occur at a lower voltage than in cells which are not selected. Even in cells supplied with the same sustaining voltage, therefore, sustaining discharge 22 does not occur if write discharge 21 does not occur.

If write discharge 21 is insufficient, therefore, then the subsequent sustaining discharge 22 becomes hard to occur. If the sustaining voltage is raised in order to avoid this problem, however, then a discharge becomes easy to occur in the cells which are not selected as well, and false lighting or false extinguishment occurs, resulting in a degraded picture quality. In other words, this means oppression of a drive margin.

A fourth problem is that the discharge space cannot be expanded. The reason is that the height of partition 6 is limited by the write voltage.

For expanding the discharge space under the condition that the cell size is fixed, it is necessary to raise the height of partition 6.

As evident from the above described reason, however, partition 6 cannot be made so high from the relation to write discharge 21.

Therefore, not only the discharge space but also the discharge region is restricted, and it becomes difficult to improve the luminance and efficiency. If the luminance or the conversion efficiency is high, bright image display can be conducted even with low power. As the luminance and efficiency of the PDP become higher, the power consumption can be decreased. In other words, this problem finally becomes an obstacle to reduction in power consumption.

A fifth problem is that the damage of the protection layer is large. The reason is that electric lines of force 23 concentrate in the electrode edge portion, the distortion of the electric field becomes large, and consequently high energy ions easily concentrate to the protection layer in the vicinity of the electrode edge, and ions are incident obliquely on the protection layer.

The protection layer not only simply protects components exposed to plasma from impact of electrically charged particles such as ion and electrons, but also functions to accelerate supply of secondary electrons to facilitate discharge generation and self-sustaining of the discharge. Therefore, the life of the protection layer, i.e., the degree of damage or degradation becomes an important factor which determines the operation life of the PDP.

As shown in FIG. 22, conventionally the sustaining discharge having a large number of times of repetitive discharge is the planar discharge. In the case of the planar discharge, electric lines of force 23 generated between scan electrode 4 and common electrode 11 are largely curved, and electric lines of force 23 densely concentrate in the edge portions of both electrodes where a potential difference is generated. Therefore, the electric field between the electrodes is remarkably distorted, and especially the electric field in the edge portions of the electrodes is remarkably distorted. As a result, the field strength near the edge portions of both electrodes is increased.

As the field strength increases, kinetic energy of ions incident on the protection layer increases, resulting in an increased degree of damage on the protection layer caused by ions. In addition, ions come flying to the protection layer along electric lines of force 23. As a result, ions are obliquely incident (24) on the protection layer with an angle of at least 0° and at most 90°. If ions are obliquely incident (24), then an energy providing factor, i.e., an energy transfer efficiency, from incident ions to atoms forming the protection layer is increased. Accordingly, the degree of damage of the protection layer becomes more serious.

FIG. 23 shows a result of a simulation for indicating dependence of a sputtering yield Y (0) of xenon (Xe) ion to magnesium oxide (MgO) at an incidence angle of 0° upon ion energy. From FIG. 23, it is found that the sputtering yield monotonously increases until the ion energy reaches 100 keV. In other words, as the incident ion energy becomes larger, the degree of damage on the protection layer becomes large. By the way, the reason why the sputtering yield tends to decrease when the energy is at least 100 keV is that the injection mode becomes dominant even in the case of a heavy ion such as Xe. Xe and MgO are gas atoms and the protection layer for ultraviolet ray generation typically used in color PDPs, respectively. Furthermore, Xe is the heaviest element among typically used gas kinds. In general, as the mass of incident ions becomes heavy, the degree of damage on the protection layer becomes large.

FIG. 24 shows a result of a simulation which indicates a sputtering yield Y (θ) at an incidence angle θ normalized by the sputtering yield Y (0) of xenon (Xe) ion to MgO at an incidence angle of 0°.

As a matter of course, the sputtering yield Y (θ) becomes maximum in the vicinity of 60 to 70°, thereafter rapidly decreases, and becomes 0 at 90°. As compared with other cases, the degree of damage on the protection layer becomes large in the case where ions are incident obliquely, as apparent from FIG. 24.

In other words, as the number of times of oblique incidence of ions on the protection layer is increased, the operation life becomes short.

As compared with the vertical discharge (in which the distortion of the electric field is small and ions are hard to be obliquely incident), the degree of damage on the protection layer thus becomes remarkably large in the planar discharge. If at least sustaining discharge 22 is made the vertical discharge, therefore, the operation life becomes longer than in the case of the planar discharge.

SUMMARY OF THE INVENTION

Therefore, an object of the present invention is to provide a PDP capable of conducting color display in which the write voltage is low, the write (address) interval can be shortened, and the drive margin is wide, as compared with the conventional technique.

Furthermore, an object of the present invention is to provide a color PDP which is higher in luminance and efficiency than that of the conventional technique.

Furthermore, an object of the present invention is to provide a color PDP which is longer in life than that of the conventional technique.

A plasma display panel of the present invention for solving the above described problems is a plasma display panel having first and second substrates opposed to each other, and conducting color image display by accelerating electrons with an electric field, causing the electrons to collide with gas atoms or molecules, and converting generated ultraviolet light to visible light with fluorescent materials. The plasma display panel includes: a plurality of pieces of a data electrode disposed on the first substrate in a column direction, and a plurality of pieces of a scan electrode disposed on the first substrate in a row direction perpendicular to the column direction; a plurality of pieces of a common electrode disposed on the second substrate in a row direction in parallel to the scan electrode; and a fluorescent material layer for emitting visible light of red (R), green (G), and blue (B) colors, and partitions for partitioning the colors and forming discharge spaces, the fluorescent material layer and the partitions being disposed between the first substrate and the second substrate.

A plasma display panel of the present invention may include the data electrode disposed on the first substrate, a dielectric layer on the data electrode, the scan electrode on the dielectric layer, and another dielectric layer on the scan electrode; a common electrode disposed on the second substrate, and a different dielectric layer on the common electrode; and a center sheet for forming discharge spaces between the first substrate and the second substrate and partitioning cells of red (R), green (G), and blue (B) colors, the center sheet including hole shaped or groove shaped opening portions having the fluorescent material layer formed therein.

A manufacturing method of plasma display according to the present invention is a manufacturing method of a plasma display whereby partitions are formed on a substrate having the data electrode and the scan electrode formed thereon. In other words, a manufacturing method of the present invention is a manufacturing method of plasma display panel. The plasma display panel has first and second substrates opposed to each other, and conducts color image display by accelerating electrons with an electric field, causing the electrons to collide with gas atoms or molecules, and converting generated ultraviolet light to visible light with fluorescent materials. The plasma display panel includes: a plurality of pieces of a data electrode disposed on the first substrate in a column direction, and a plurality of pieces of a scan electrode disposed on the first substrate in a row direction perpendicular to the column direction; a plurality of pieces of a common electrode disposed on the second substrate in a row direction in parallel to the scan electrode; and a fluorescent material layer for emitting visible light of red (R), green (G), and blue (B) colors, and partitions for partitioning the colors and forming discharge spaces, the fluorescent material layer and the partitions being disposed between the first substrate and the second substrate. The manufacturing method of plasma display panel according to the present invention includes the steps of: forming a plurality of pieces of the data electrode on the first substrate; forming a first dielectric layer on the data electrode; forming a plurality of the scan electrode on the first dielectric layer; forming a second dielectric layer on the scan electrode; forming the partitions on the second dielectric layer; forming the fluorescent material layer on the second dielectric layer including side surfaces of the partitions; forming a plurality of pieces of the common electrode on the second substrate; and forming a third dielectric layer on the common electrode.

Another manufacturing method of plasma display panel according to the present invention is a manufacturing method of a plasma display panel whereby partitions are formed on a substrate having the common electrode formed thereon. The manufacturing method of plasma display panel according to the present invention includes the steps of: forming a plurality of pieces of the data electrode on the first substrate; forming a fourth dielectric layer on the data electrode; forming a plurality of the scan electrode on the fourth dielectric layer; forming a fifth dielectric layer on the scan electrode; forming a plurality of pieces of the common electrode on the second substrate; forming a sixth dielectric layer on the common electrode; forming the partitions on the sixth dielectric layer; and forming the fluorescent material layer on the sixth dielectric layer including the partitions.

A different manufacturing method of plasma display according to the present invention is a manufacturing method of a plasma display having a center sheet instead of the partitions. The center sheet forms discharge spaces between the first substrate and the second substrate and partitions cells of red (R), green (G), and blue (B) colors. The center sheet includes hole shaped or groove shaped opening portions having the fluorescent material layer formed therein. The manufacturing method of plasma display panel according to the present invention includes the steps of: forming a plurality of pieces of the data electrode on the first substrate; forming a seventh dielectric layer on the data electrode; forming a plurality of the scan electrode on the seventh dielectric layer; forming an eighth dielectric layer on the scan electrode; forming a plurality of pieces of the common electrode on the second substrate; forming a ninth dielectric layer on the common electrode; and forming the center sheet between the first substrate and the second substrate.

A drive method of plasma display panel according to the present invention includes display write operation of applying a signal voltage pulse and a write voltage pulse having the same timing and opposite polarities to the data electrode and the scan electrode, respectively and generating a write discharge or address discharge in other words in a selected pixel; and luminous sustaining operation of applying sustaining voltage pulses having different timing and same polarity to the scan electrode and the common electrode, respectively and generating a sustaining discharge in a selected pixel.

In the luminous sustaining operation in the drive method of plasma display panel according to the present invention, a bipolar sustaining voltage pulse may be applied to the common electrode to generate a sustaining discharge in a selected pixel.

A drive device of plasma display panel according to the present invention is a drive device implementing the above described drive method.

According to the present invention heretofore described, a first effect is that the write voltage can be lowered as compared with the conventional technique. As a result, circuits which are inexpensive and low as compared with the conventional technique can be used, and a manufacturing cost concerning the drive circuits can be reduced, because the write (address) discharge 21 can be caused near the minimum firing voltage given by the Paschen's law.

A second effect is that the write interval can be made shorter as compared with the conventional technique. As a result, a panel having a larger screen and higher definition as compared with the conventional technique can be implemented. Because the write voltage lowers and the statistical discharge probability increases.

A third effect is that the drive margin can be widened as compared with the conventional technique. The reason is that the probability of sufficient generation of the write discharge (address discharge) 21 becomes higher, and consequently the probability of generation of the subsequent sustaining discharge 22 also becomes higher.

A fourth effect is that the discharge space can be expanded as compared with the conventional technique. Accordingly, the quantity of emitted light can be increased by expansion of the discharge region. Thus, the luminance and efficiency can be increased as compared with the conventional technique. As a result, the power consumption can be decreased as compared with the conventional technique. Because the height of the partitions cannot be limited by the write voltage, unlike the conventional technique.

A fifth effect is that the irradiation damage of the protection layer 7 can be decreased as compared with the conventional technique. As a result, the operation life of the panel can be extended as compared with the conventional technique. The reason is that the sustaining discharge 22 causing the greatest number of times of ion impact becomes the vertical discharge, and consequently the distortion of the local electric field and oblique incidence of ions on the protection layer 7 are reduced, and the voltage change caused by degradation of the protection layer 7 is suppressed.

A sixth effect is that it is possible to decrease the electrode resistance and increase the cell aperture factor as compared with the conventional technique. As a result, a panel having a larger screen and higher definition as compared with the conventional technique can be implemented. Because only the common electrode 11 exists on the display surface side, and in addition, every electrode wiring can be formed of only a metal material having low resistance.

A seventh effect is that false lighting and false extinguishment due to discharge interference between cells adjacent in the longitudinal direction are hard to occur. As a result, the drive margin can be improved as compared with the conventional technique. The reason will now be described. The write discharge 21 is concentrated to an intersection of the data electrode 2 and the scan electrode 4. In addition, the scan electrode 4 and the common electrode 11 which cause the sustaining discharge 22 are opposed to each other via the discharge space. Therefore, electric lines of force emitted from one of the electrodes enter the other of the electrodes nearly at right angles. In particular, the leak of the electric lines of force to a cell adjacent in the longitudinal direction is reduced. In its turn, diffusion of plasma is reduced.

An eighth effect is that it is relatively easy to cause the sustaining discharge 22 as compared with the conventional technique. Therefore, the space between the scan electrode 4 and the common electrode 11 can be widened as compared with the conventional technique without causing an extreme rise of the sustaining voltage. As a result, the luminance and efficiency are improved by expansion of the discharge region. The reason is that the whole space between the scan electrode 4 and the common electrode 11 which are opposed to each other acts as an effective discharge gap, and at the same time the whole area of overlap functions as an effective discharge area (volume effect and area effect of discharge).

A ninth effect is that a sufficient drive margin can be secured even if the cell is minute as compared with the conventional technique. Therefore, a panel of higher definition as compared with the conventional technique can be implemented. Because it is easy to cause a discharge in a space which is narrow as compared with the conventional technique.

A tenth effect is that the discharge region, i.e., the quantity of emitted light in a cell of the same volume can be increased. As compared with the conventional technique, therefore, the luminance and efficiency can be further increased. Because the scan electrode 4 and the common electrode 11 performing the sustaining discharge 22 are formed via the discharge space with a shift between in the oblique direction.

An eleventh effect is that the thickness of the dielectric layers 3 and 5 influencing the write voltage and the sustaining voltage and the height of the partitions 6 can be prescribed in the same substrate process. As compared with the conventional technique, therefore, the dispersion of the write voltage and the sustaining voltage in the panel surface and every manufacturing lot can be made smaller. The reproducibility of the voltage characteristics can also be made higher. Because dimension factors which define respective voltage values do not extend over separate substrates, but are concentrated to the substrate of only one side.

A twelfth effect is that the manufacturing precision and the manufacturing yield can be improved. As a result, the manufacturing cost can be reduced. Because the processes in which a precision is demanded as to the positioning are concentrated to the substrate of one side, and the characteristics are hard to be influenced by a shift at the time of superposition.

A thirteenth effect is that the degradation caused in the protection layer 7 formed on the back glass substrate 1 side during the manufacturing process can be suppressed. As a result, the voltage rise and reliability lowering caused by the degradation of the protection layer 7 can be reduced. Because the manufacturing process after the protection layer 7 formed on the back glass substrate 1 side (the forming process of the fluorescent material layers 8) can be omitted by using the center sheet 17.

A fourteenth effect is that the manufacturing yield of the panel as a whole can be improved. As a result, the manufacturing cost can be reduced. Because the process for forming the partitions and the fluorescent material layers which is the most important and difficult in the PDP manufacturing process can be separated from the manufacturing process of the glass substrates by using the center sheet 17 and the center sheet 17 can be manufactured in a dedicated process.

A fifteenth effect is that the write voltage can be at most approximately the sustaining voltage. As a result, the reliability and the voltage characteristics of the drive circuits connected to the data electrode 2 and the scan electrode 4 can be improved. Because the data electrode 2 and the scan electrode 4 which cause the write discharge (address discharge) 21 are formed on the same substrate via the dielectric layers 3 and 5.

BRIEF EXPLANATION OF THE DRAWINGS

FIG. 6 is a table of comparison in configuration between the conventional technique and the present invention.

FIG. 7 is a table of comparison in characteristics between the conventional technique and the present invention.

PREFERRED EMBODIMENT OF THE INVENTION

Embodiment 1

Figure 1:
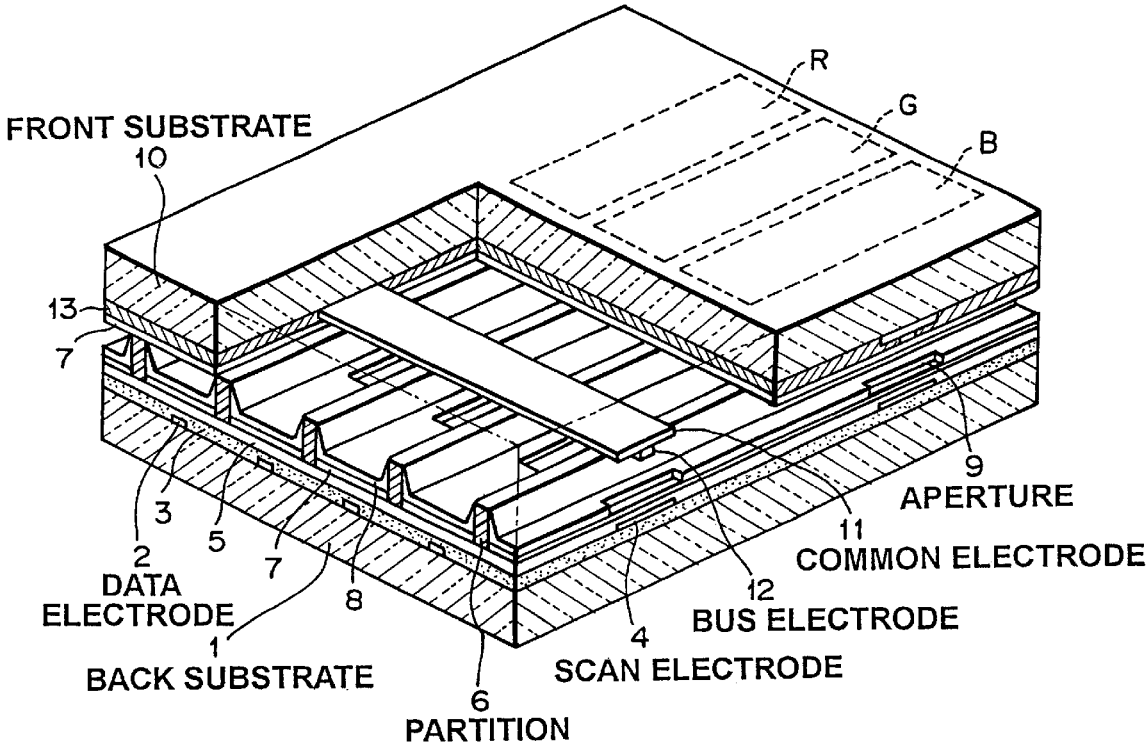
FIG. 1 is an oblique view showing the panel structure of the present invention.
Figure 2:
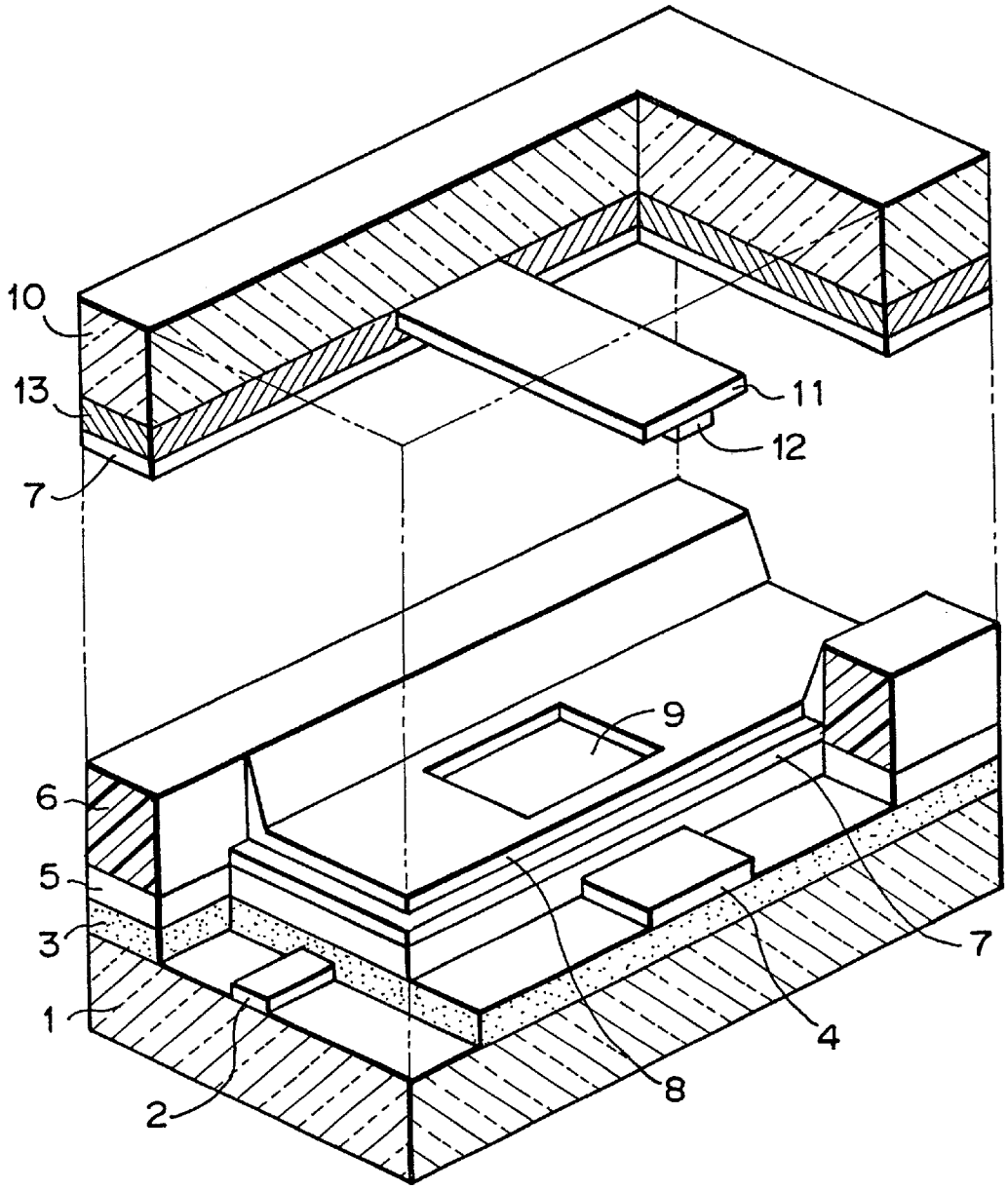
FIG. 2 is an oblique exploded view showing a unit cell structure.

FIG. 1 is an exploded oblique view of a plasma display panel (PDP) according to the present invention. Furthermore, FIG. 2 is an exploded oblique view showing a unit cell structure of a PDP according to the present invention. By referring to FIGS. 1 and 2, the structure of the present invention will be described. On a back glass substrate 1, data electrodes 2 made of metal or the like are formed in the substrate column direction. Over the data electrodes 2, a dielectric layer 3 made of a metallic oxide or the like is formed. On the dielectric layer 3, scan electrodes 4 made of metal or the like are formed in a substrate row direction. Over the scan electrodes 4, a dielectric layer 5 made of a metallic oxide or the like is formed. On the dielectric layer 5, stripe-shaped partitions 6 made of a metallic oxide or the like are formed in the substrate column direction. On the dielectric layer 5 including side faces of the partitions 6, a protection layer 7 and a fluorescent material layer 8 are successively deposited.

On the other hand, on a front glass substrate 10, transparent conductive common electrodes 11 made of a metallic oxide or the like and bus electrodes 12 electrically connected to the common electrodes 11 and made of metal or the like are formed in the substrate row direction so as to be opposed to the scan electrodes 4. Over the common electrodes 11 and the bus electrodes 12, a dielectric layer 13 made of a metallic oxide or the like and a protection layer 7 are deposited successively. The back glass substrate 1 and the front glass substrate 10 are stuck together so as to have their structures inside by using frit glass seal or the like for hermetic seal. Within space thus formed, gas for a discharge containing noble gas or the like is let in. In other words, single composition gas of helium (He), neon (Ne), argon (Ar), krypton (Kr), or xenon (Xe), or mixed gas containing at least two components is let in.

Figure 3A:
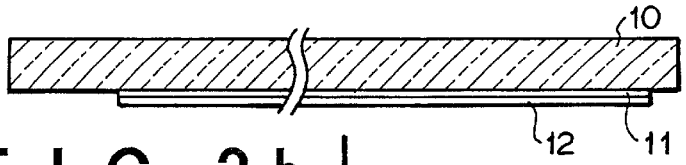
FIGS. 3*a* to 3*f* are sectional views showing a manufacturing method of the present invention.

FIGS. 3*a* to 3*f* are sectional views showing manufacturing processes of a unit cell of the PDP according to the present invention. First, a process of the front glass substrate 10 side will now be described. First of all, a common electrode 11 is formed on the front glass substrate 10. At that time, the coating method (deposition method using spray, a spin coater, a comma coater, or the like), the printing method (selective pattern forming method using screen printing or relief printing), the photosensitive resin method (selective pattern forming method using exposure of photosensitive resin), the vacuum film forming method (pattern forming method including a deposition process using evaporation, sputtering, chemical vapor deposition (CVD), or the like, and a mask processing process using photolithography), the plating method (selective pattern forming method using electrolytic plating and electroless plating, or pattern forming method combined with a mask forming process using photolithography), the writing method (selective and direct pattern forming method using ink jet), or the like is used. Thereafter, the bus electrode 12 is formed on the common electrode 11. At that time, the coating method, the printing method, the photosensitive resin method, the vacuum film forming method, the plating method, the writing method, or the like is used (FIG. 3*a*).

Figure 3B:
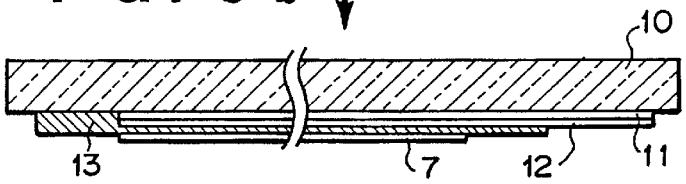

Subsequently, on the common electrode 11 and the bus electrode 12, the dielectric layer 13 is formed by using the coating method, the printing method, the photosensitive resin method, the vacuum film forming method, the plating method, the writing method, or the like. Thereafter, the protection layer 7 is formed on the dielectric layer 13 by using the vacuum evaporation method, the coating method, or the like (FIG. 3*b*).

Figure 3F:
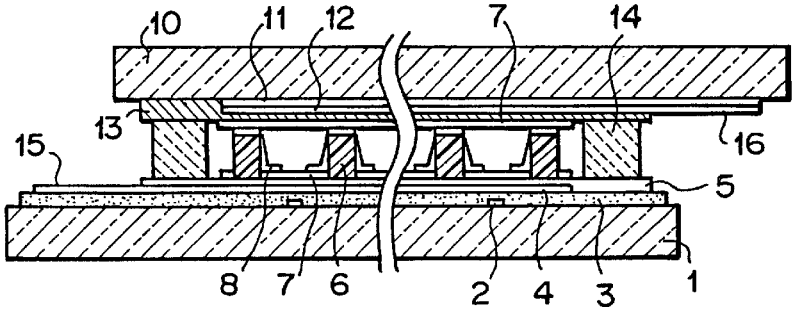
Figure 3C:
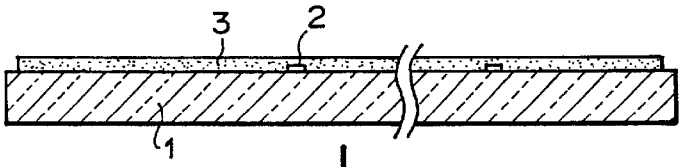

A process of the back glass substrate 1 side will now be described. First, the data electrodes 2 are formed on the back glass substrate 1 by using the printing method, the photosensitive resin method, the vacuum film forming method, the plating method, the writing method, or the like. Thereafter, the dielectric layer 3 is formed on the data electrodes 2 by using the coating method, the printing method, the photosensitive resin method, the vacuum film forming method, or the like (FIG. 3*c*).

Figure 3D:
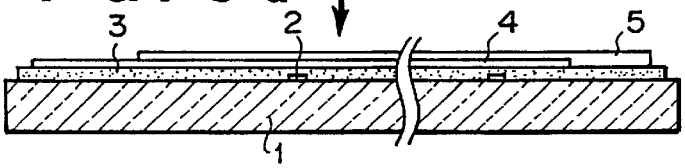

Subsequently, the scan electrodes 4 are formed on the dielectric layer 3 by using the printing method, the photosensitive resin method, the vacuum film forming method, the plating method, the writing method, or the like. Thereafter, the dielectric layer 5 is formed on the scan electrodes 4 by using the coating method, the printing method, the photosensitive resin method, the vacuum film forming method, or the like (FIG. 3*d*).

Figure 3E:
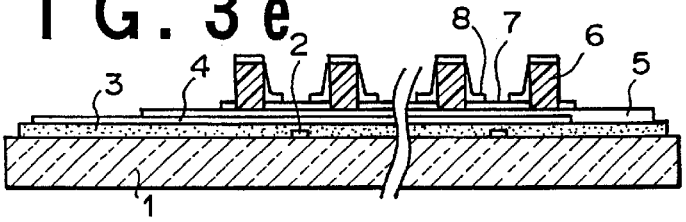

Subsequently, the partitions 6 are formed on the dielectric layer 5. At that time, the printing method, the photosensitive resin method, the vacuum film forming method, the additive method (pattern forming method of embedding a material in a convex portion formed of photosensitive resin or the like), the sand blast method (pattern forming method using cutting with a mask), the press shaping method (full pattern forming method using a die, a mold, or the like), or the like is used. Thereafter, on the dielectric layer 5 and the partitions 6, the protection layer 7 is formed by using the vacuum film forming method, the coating method, or the like. Furthermore, in cells corresponding to colors of red (R), green (G) and blue (B), fluorescent material layers 8 respectively for red color light emission, green color light emission, and blue color light emission are formed by using the printing method, the photosensitive resin method, the writing method, or the like (FIG. 3*e*).

A panel assembling process will now be described. First of all, frit glass seal or the like is provided on a substrate fringe portion of either the front glass substrate 10 or the back glass substrate 1. The front glass substrate 10 and the back glass substrate 1 are stuck together so as to oppose the scan electrodes 4 to common electrodes 11 paired therewith, respectively, and the substrates are hermetically sealed. Thereafter, via a gas exhaust-intake pipe provided in the panel peripheral portion, residual impurities within the panel, such as organic matters, are removed by baking, discharge cleaning, or the like, and vacuum evacuation of the inside of the panel is conducted. Finally, gas for a discharge is let in from the pipe, and the pipe is hermetically sealed. The panel manufacturing process is finished (FIG. 3*f*).

Figure 4A:
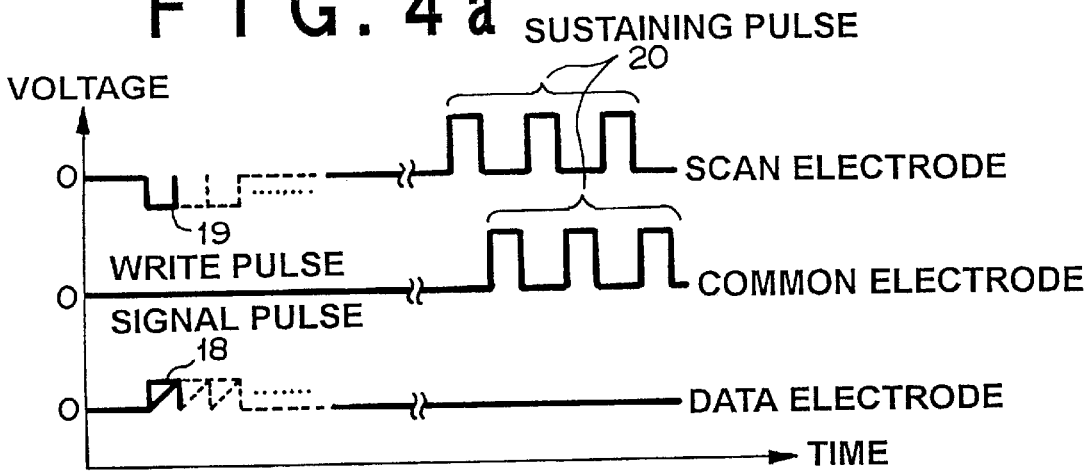
FIGS. 4*a* and 4*b* are voltage waveforms showing a drive method of the present invention.
Figure 4B:
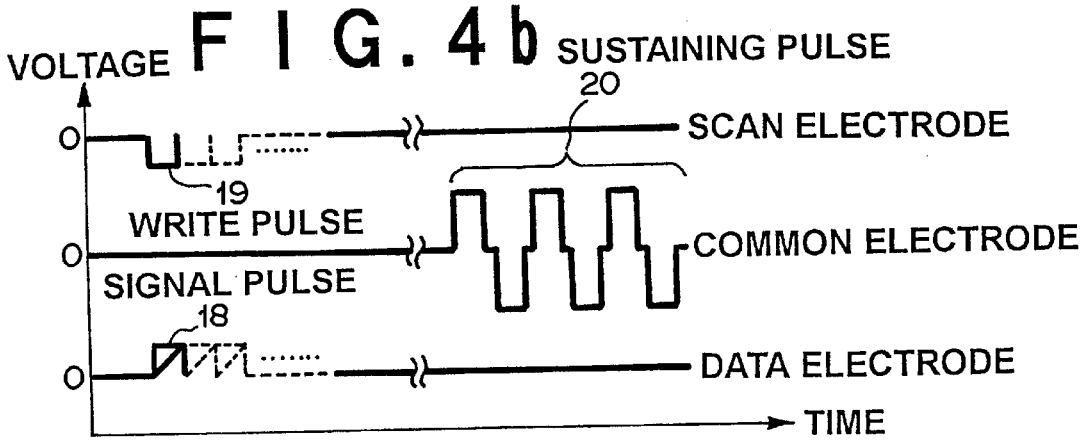
Figure 5:
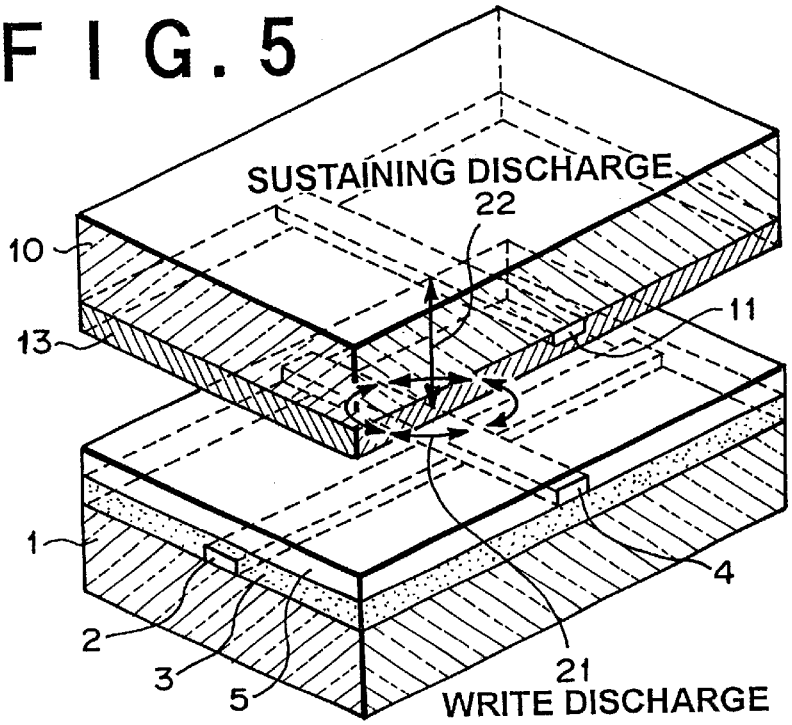
FIG. 5 is an oblique view showing a discharge region of the present invention.

FIGS. 4*a* to 4*b* are voltage waveforms showing a PDP drive method according to the present invention. FIG. 5 is an oblique view showing a discharge generation region of the PDP according to the present invention. In FIG. 5, mainly a portion relating to the electrodes are illustrated. First of all, a drive method of FIG. 4*a* will now be described. A data electrode 2 and a scan electrode 4 of a cell to be desired to conduct luminous display are supplied respectively with a signal pulse 18 (Vd) and a write pulse (address discharge) 19 (Vw), which are opposite in polarity, at the same timing to generate a write discharge (address discharge) 21 (planar discharge). Thereafter, the scan electrode 4 and the common electrode 11 are supplied with sustaining pulses 20 (Vs) having the same polarity alternately at different timing to generate a sustaining discharge 22 (vertical discharge).

Here, the signal pulse 18 is a voltage pulse independently applied to the data electrode 2 during the write interval (an interval for bringing a predetermined cell into a selection state, i.e., luminous ready state). It is a voltage pulse for bringing a predetermined cell into a selection state. Furthermore, the write pulse 19 is applied to the scan electrodes 4 during the write interval in a line sequential manner. The write pulse 19 is a voltage pulse for bringing a cell supplied with the signal pulse 18 into a selection state. Furthermore, the sustaining pulse 20 is a voltage pulse alternately applied to the scan electrode 4 and the common electrode 11 during the sustaining interval (an interval during which the selected cell is made its luminous state). The sustaining pulse 20 is a voltage pulse for bringing a cell made selection state into a display state. The peak value of the sustaining voltage applied to the scan electrode and that applied to the common electrode need not necessarily be the same.

One of features of the plasma display panel (PDP) according to the present invention is that the ratio between the sustaining discharge voltage and the write discharge voltage (address discharge voltage) can be made larger as compared with the conventional PDP of planar discharge type. It is now assumed that the write pulse, the signal pulse, the sustaining pulse applied to the scan electrode, and the sustaining pulse applied to the common electrode are in magnitude Vw, Vd, Vss, and Vsc, respectively. For example, in the conventional PDP of planar discharge type, at least, |Vss| and |Vsc| must be smaller than (|Vd|+|Vw|) in order to prevent occurrence of a false discharge.

On the other hand, in the PDP of the present invention, it is possible to make especially the sustaining pulse Vsc applied to the common electrode because of the electrode arrangement. |Vsc| can be made larger than (|Vd|+|Vw|). If the sustaining pulse Vss supplied to the scan electrode is made too large, then a false discharge occurs between the scan electrode and the data electrode during the sustaining interval. Therefore, it is difficult to make Vss as large as Vsc. By providing a bias during the sustaining interval, however, Vss can be increased. In the same way, assuming that larger one of the positive polarity side peak value and the negative polarity side peak value of the above described bipolar sustaining voltage pulse applied to the common electrode is |Vs|, the relation (|Vd|+|Vw|)<|Vs| may be satisfied.

In FIGS. 4*a* and 4*b*, such a drive method that the write pulse 19 is separated from the sustaining pulse 20 is shown. As a matter of course, however, such a drive method that the write pulse 19 and the sustaining pulse 20 are mixed may be used besides the method. Furthermore, in order to conduct the drive positively, a preparatory sequence such as a preliminary discharge may be provided prior to the write discharge 21 as disclosed in, for example, JP3-219286 A (1991). Furthermore, besides the alternating voltage applying method of applying the sustaining pulses 20 alternately to the scan electrode 4 and the common electrode 11 with shifted phases as shown in FIG. 4*a*, bipolar (positive and negative) sustaining pulses 20 may be applied to one of the electrodes as shown in FIG. 4*b*.

Particularly in FIG. 4*b*, the scan electrode 4 and the data electrode 2 are supplied with the same voltage or a small voltage difference (such a voltage as not to cause a discharge between the data electrode 2 and the scan electrode 4) between them, and bipolar sustaining pulses 20 are applied to the common electrode 11. By adopting the method shown in FIG. 4*b*, there is brought about an effect that an unintended discharge can be prevented from occurring between the data electrode 2 and the scan electrode 4 when the sustaining pulses 20 are applied. This drive method is very effective especially in the case where a discharge start voltage required for the write discharge 21 (caused by the planar discharge) between the data electrode 2 and the scan electrode 4 is designed so as to become considerably smaller than a discharge start voltage required for the sustaining discharge 22 (caused by the vertical discharge) between the scan electrode 4 and the common electrode 11. By the way, the voltage shown in FIGS. 4*a* and 4*b* need not be formed by taking the ground potential as its reference. According to the convenience of circuit elements to be used, the circuit elements may be used in such a state that the whole circuit is biased so that, for example, all pulses will have positive polarities. Furthermore, the relative potential relations need only be maintained.

Furthermore, in the drive method of the present invention, it becomes possible to cause sustaining discharge operation by using only the common electrode 11 side which does not need an IC (integrated circuit) as shown in FIG. 4*b*. This means that an inexpensive low withstanding voltage drive IC can be used in the drive circuit of the scan electrode 4 side as well.

Figure 15:
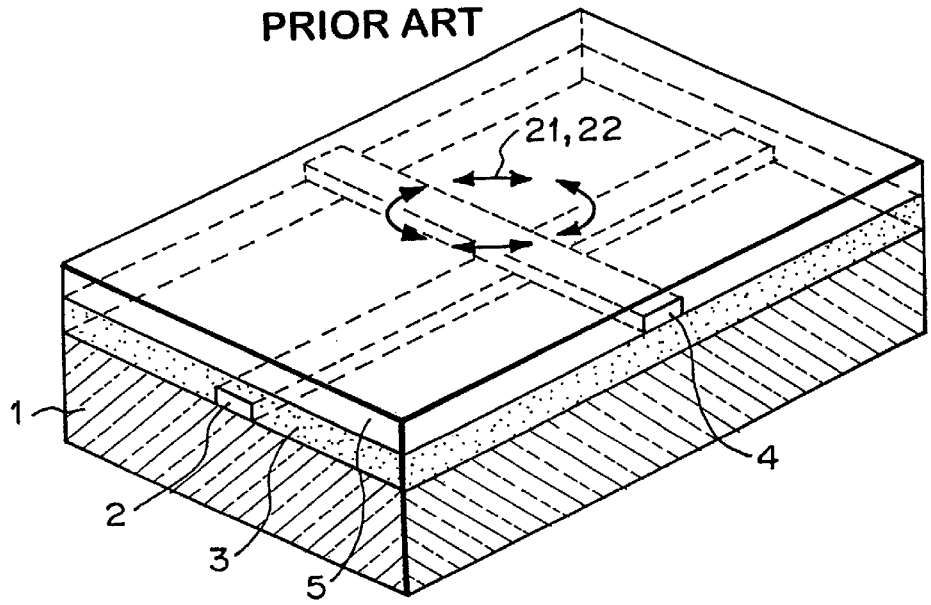
FIG.15 PRIOR ART
FIG. 15 is an oblique view showing a conventional structure.
Figure 16:
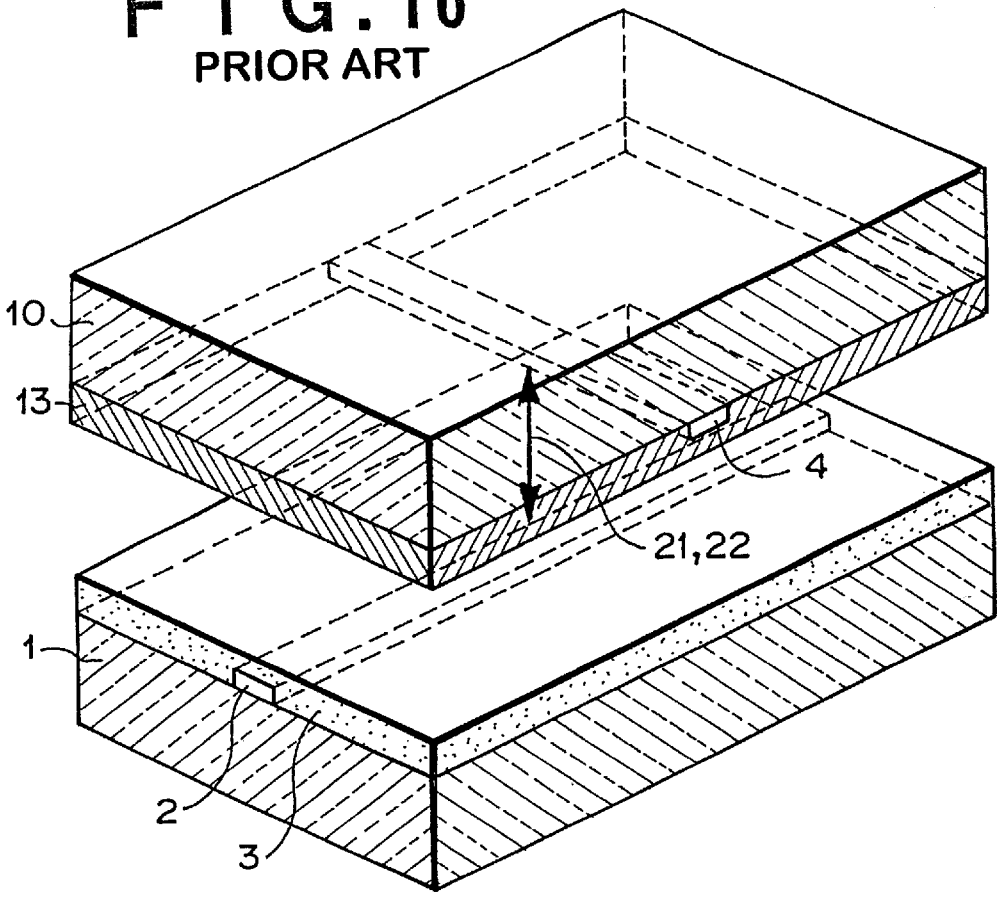
FIG. 16 PRIOR ART
FIG. 16 is an oblique view showing a conventional structure.

In the PDP of the present invention, the data electrode 2 and the scan electrode 4 are formed on the same substrate so as to be perpendicular. Therefore, the electrode gap, i.e., the write discharge gap continuously changes centering around the electrode intersection. Therefore, there exist a plurality of discharge gaps capable of causing a write discharge 21 in the vicinity of the minimum firing voltage given by the Paschen's law. The discharge probability is drastically improved. Unlike the conventional structures shown in FIGS. 16 and 18, therefore, it becomes possible to lower the write voltage without lowering the height of the partitions 6. As a result, drive circuits such as a data driver IC and a scan driver IC respectively connected to the data electrode 2 and the scan electrode 4 can be changed from conventional expensive high withstanding voltage circuits to inexpensive low withstanding voltage circuits. Thus, a manufacturing cost concerning the drive circuits can thus be reduced. Furthermore, since the statistical discharge probability is increased, the cell selection interval, i.e., time during which the write voltage is applied can be shortened as compared with the conventional technique. As a result, a panel having a larger screen and higher definition as compared with the conventional technique can be implemented. Furthermore, since the write discharge 21 can be sufficiently generated, it also becomes easy to generate subsequent sustaining discharge 22 and the drive margin can be widened as compared with the conventional technique. As a result, a picture quality higher than that of the conventional technique can be achieved. These effects are not obtained in the conventional structures shown in FIGS. 16 and 18. In addition, since the height of the partitions 6 is not limited by the write discharge (address discharge), the discharge space can be expanded as compared with the conventional technique. In other words, in the structure of the present invention, it is easy to increase the quantity of radiated light by expanding the discharge region. As a result, the luminance and efficiency can be increased and the power consumption can be decreased as compared with the conventional technique. This is impossible in the conventional structures shown in FIGS. 15, 16, 17 and 18. In addition, unlike the conventional structures shown in FIGS. 15, 17 and 18, the sustaining discharge 22 becomes the vertical discharge. Therefore, the local electric field distortion (concentration of electric lines of force) and oblique incidence of ions on the protection layer 7 are reduced. As compared with the conventional technique, therefore, it becomes possible to reduce the irradiation damage on the protection. As a result, the voltage change caused by degradation of the protection layer 7 is suppressed, and the operation life as the panel can be extended as compared with the conventional technique. This is impossible in the conventional structures shown in FIGS. 15, 17 and 18 in which the sustaining discharge 22 becomes a planar discharge.

Figure 18:
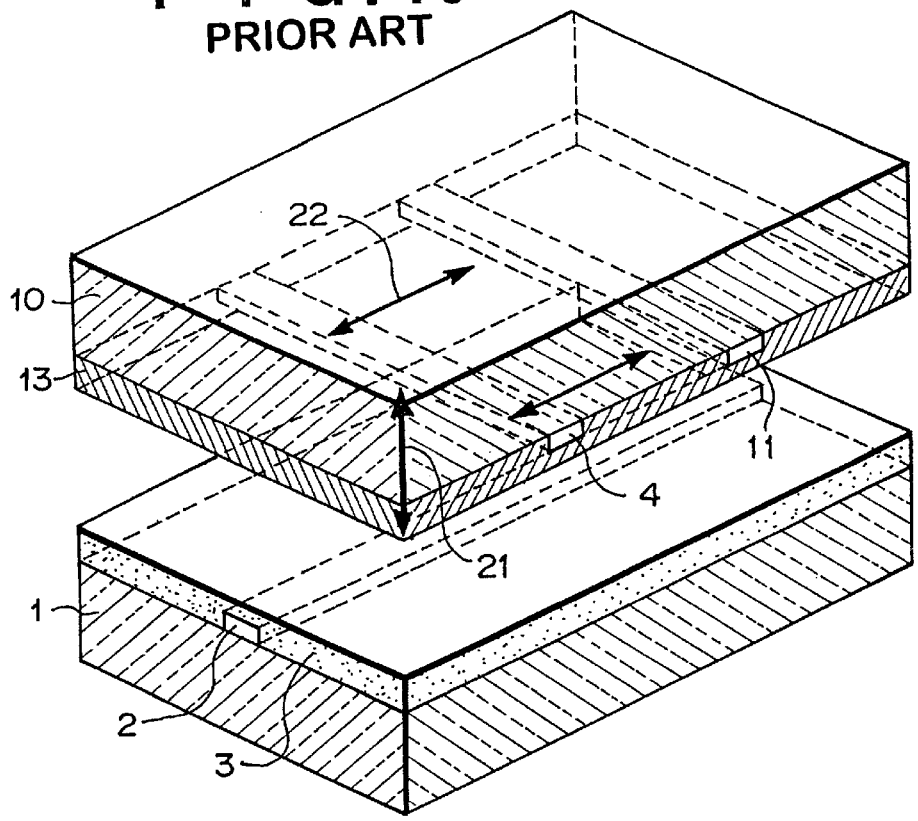
FIG. 18 PRIOR ART
FIG. 18 is an oblique view showing a conventional structure.
Figure 19:
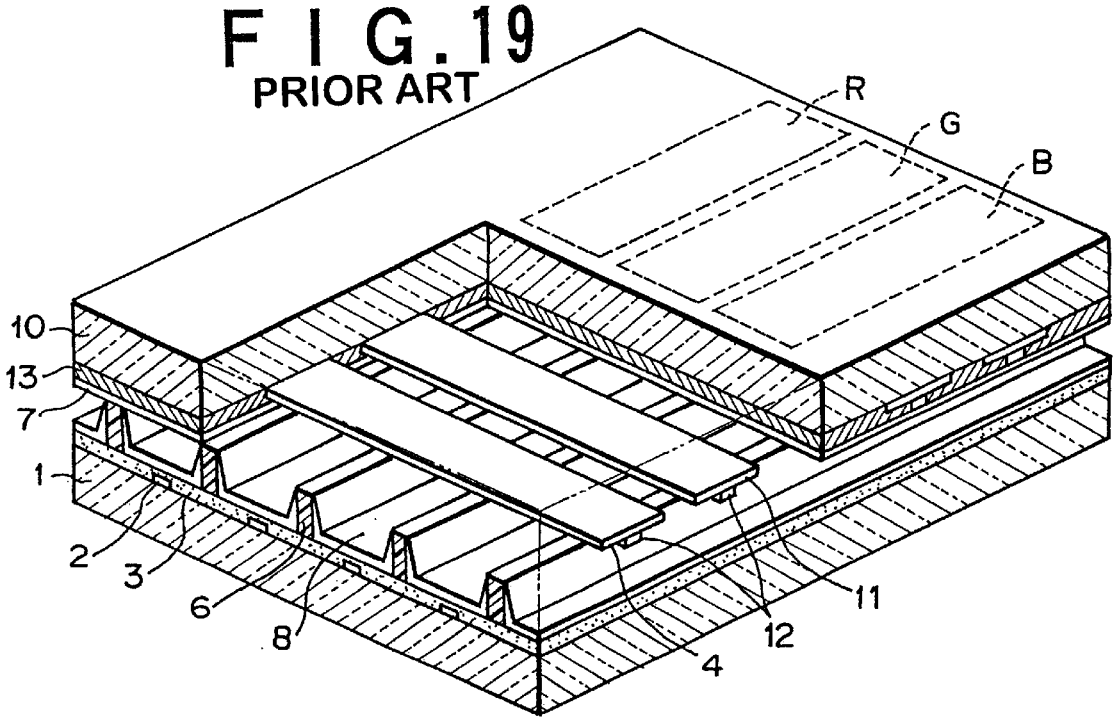
FIG. 19 PRIOR ART
FIG. 19 is an oblique view showing a detailed panel structure of FIG. 18.
Figure 20:
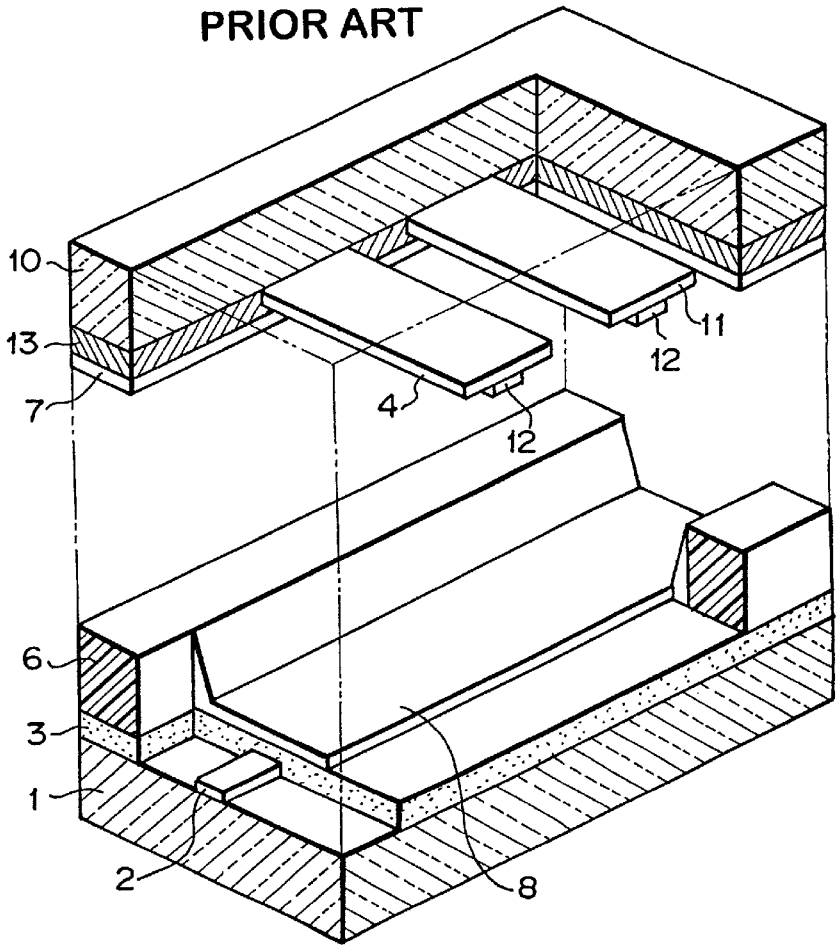
FIG. 20 PRIOR ART
FIG. 20 is an oblique exploded view showing a detailed unit cell structure of FIG. 19.
Figure 21:
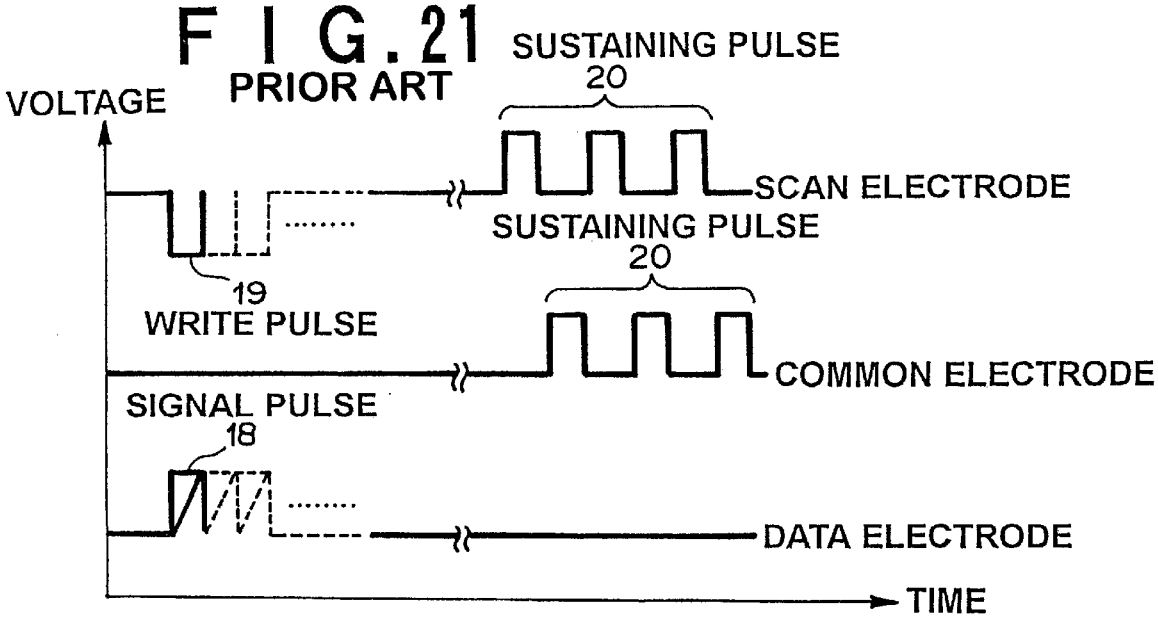
FIG. 21 PRIOR ART
FIG. 21 is a voltage waveform diagram showing a conventional drive method.
Figure 22:
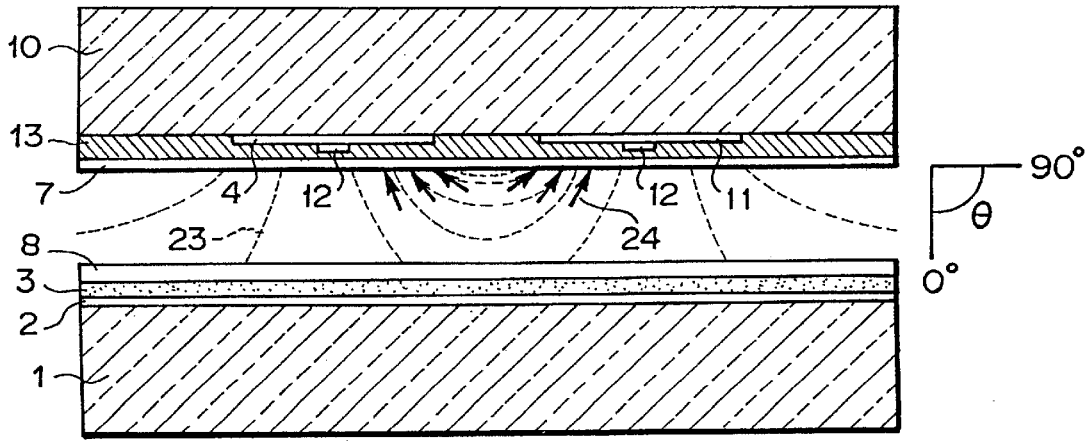
FIG. 22 PRIOR ART
FIG. 22 is a schematic diagram showing electric lines of force and the ion incidence direction in the planar discharge.
Figure 23:
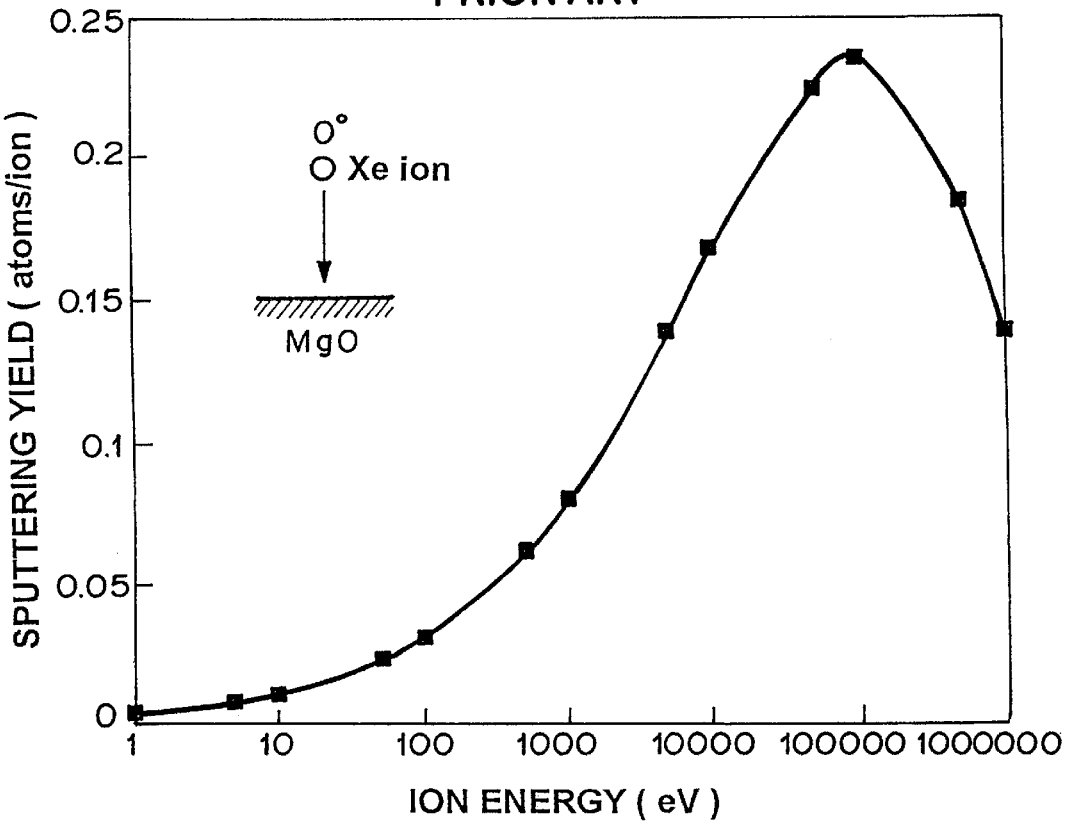
FIG. 23 PRIOR ART
FIG. 23 is a diagram showing dependence of the sputtering yield upon ion energy.
Figure 24:
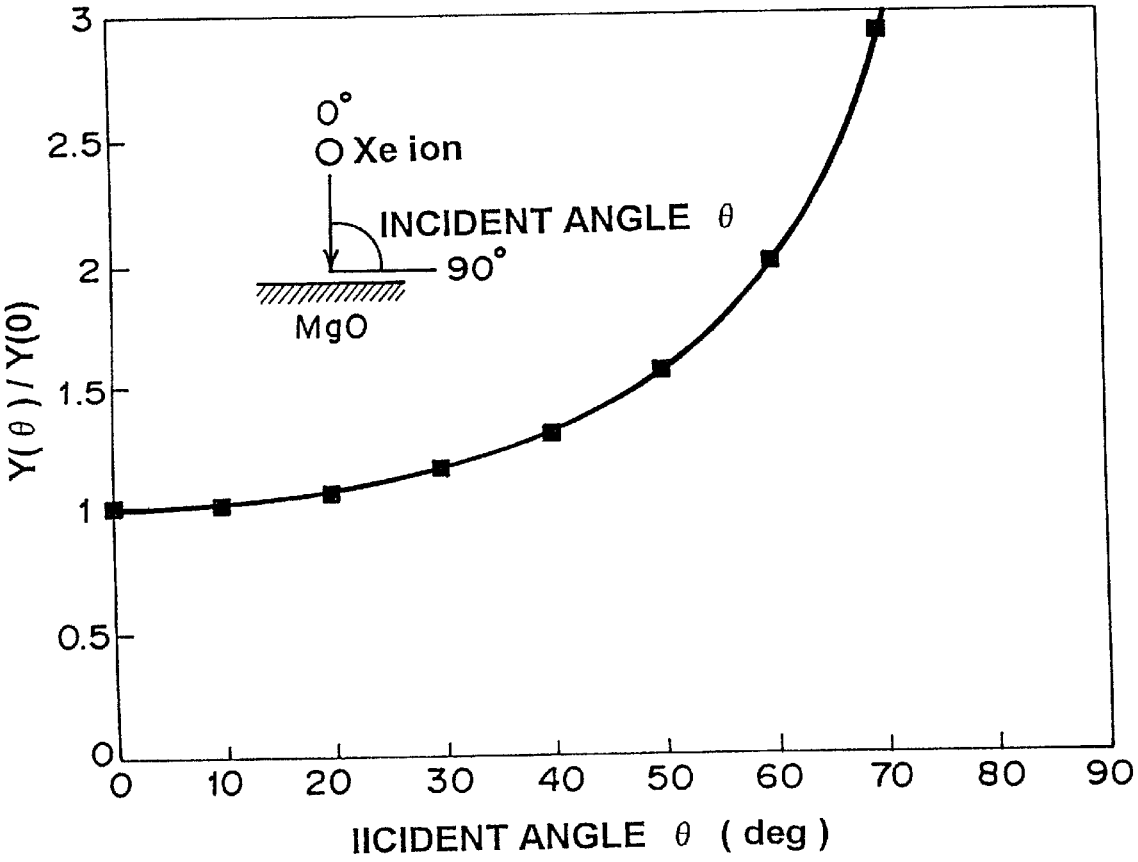
FIG. 24 PRIOR ART
FIG. 24 is a diagram showing dependence of the sputtering yield upon the ion incidence angle.

Furthermore, in the conventional structure as shown in, for example, FIG. 18, the scan electrode 4 and the common electrode 11 are provided on the front glass substrate 10 side which is the display surface side. Therefore, the scan electrode 4 and the common electrode 11 need to be transparent in order not to prevent the luminous display. In general, however, a transparent conductive material containing a metallic oxide is higher in electric resistance value than a metallic material by several figures. Therefore, the transparent conductive material by itself has a problem that the picture quality degradation caused by a pulse delay is remarkable. In the conventional technique, it is necessary to provide bus electrodes 12 for voltage pulse transfer, made of metal or the like, aiming at resistance lowering, along the scan electrode 4 and the common electrode 11. Since the bus electrode 12 itself is not transparent, however, the aperture factor of the cell is lowered. As a result, the electrode width per line of the bus electrode is also restricted. In other words, these mean the restriction of the electrode resistance and cell aperture factor, and express an obstacle to a larger screen and higher definition. On the other hand, in the PDP of the present invention, the data electrode 2 and the scan electrode 4 requested to be low in resistance are provided on the back glass substrate 1 side which is opposite to the display surface side. Therefore, the data electrode 2 and the scan electrode 4 do not become an obstacle to the luminous display. Accordingly, the data electrode 2 and the scan electrode 4 need not be transparent. As a result, an opaque metal material having low resistance can be used. On the other hand, only the common electrode 11 exists on the display surface side. Even if the bus electrode 12 is provided on the common electrode 11 as shown in FIG. 1, therefore, lowering of the aperture factor can be suppressed as compared with the conventional technique. Furthermore, since the electrode width per line of the bus electrode can be widened, it becomes possible to consequently lower the resistance of the common electrode 11 as well. In other words, the structure of the present invention is suitable for a larger screen and higher definition as compared with the conventional structure. In addition, sufficiently high luminance is obtained in the structure of the present invention as described earlier. Therefore, it is also possible to form the common electrode 11 of only a metal material. In this case, the bus electrode 12 becomes unnecessary. Accordingly, the number of steps of the manufacturing process corresponding thereto can be reduced. In addition, all electrode materials can be unified to the same metal material. Therefore, it becomes possible to reduce the cost concerning the manufacturing facilities and materials in use.

Figure 17:
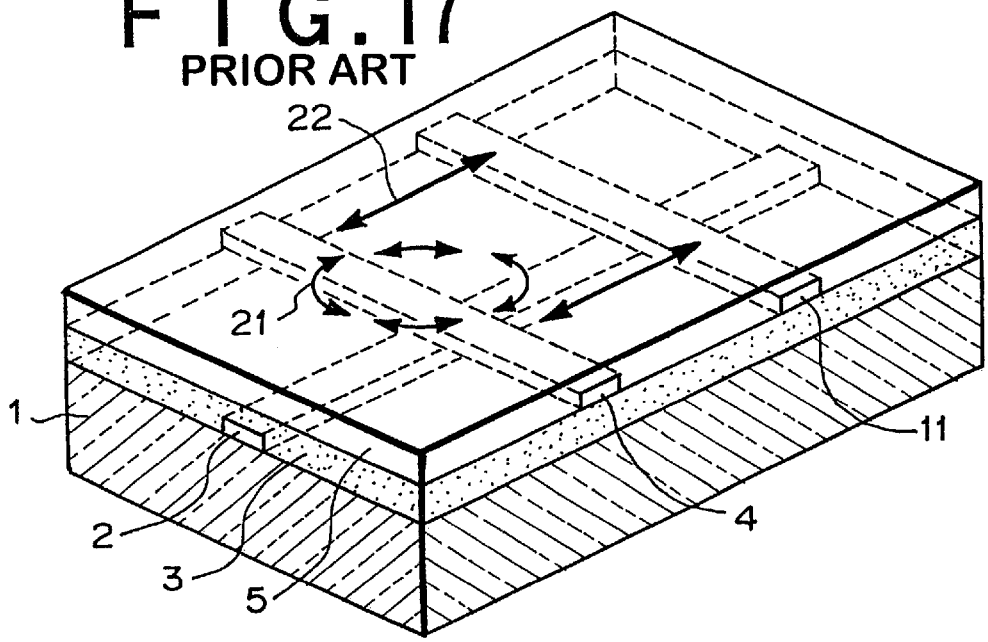
FIG. 17 PRIOR ART
FIG. 17 is an oblique view showing a conventional structure.

In the PDP of the present invention, false lighting and false extinguishment caused by discharge interference between adjacent cells in the longitudinal direction are hard to occur as compared with the conventional structures shown in FIGS. 17 and 18. As shown in FIG. 5, the reason is that the write discharge 21 is concentrated upon the intersection of the data electrode 2 and the scan electrode 4, the electric lines of force generating the sustaining discharge 22 are generated nearly vertically between the scan electrode 4 and the common electrode 11, and diffusion of plasma to cells adjacent in the longitudinal direction is hard to occur. As a result, the drive margin can be improved as compared with the conventional technique. Furthermore, there is also an advantage that it is relatively easy to cause the sustaining discharge 22. The reason is that the sustaining discharge 22 becomes an vertical discharge unlike the conventional structures shown in FIGS. 17 and 18, and consequently the whole gap between the scan electrode 4 and the common electrode 11 which are opposed to each other acts as an effective discharge gap, and in addition the whole overlap area also functions as an effective discharge area. Accordingly, the discharge probability is increased by the so-called volume effect and the area effect of the discharge, and the rise of the sustaining voltage can be suppressed. As a result, it becomes possible to widen the gap between the scan electrode 4 and the common electrode 11 as compared with the conventional technique without causing an extreme rise of the sustaining voltage. It also becomes possible to improve the luminance and efficiency because of expansion of the discharge region. In addition, the fact that the electrode area can be used effectively means that it is easy to cause a discharge even in an accordingly narrow space. Even in a cell which is more minute as compared with the conventional technique, therefore, it becomes possible to secure a sufficient drive margin. As a result, it is easy to implement a panel which is higher in definition as compared with the conventional technique.

A table shown in FIG. 6 compares the configuration of the structure of the present invention with that of the conventional structure. As evident from this table, the structure of the present invention does not coincide with any of conventionally known structures.

A table shown in FIG. 7 compares features of the structure of the present invention with those of the conventional structure. As evident from this table, the structure of the present invention is superior to any of conventionally known structures.

In the tables, A, B, C, D and E correspond to FIGS. 15, 16, 17, 18 and 5, respectively. Furthermore, electrode arrangement symbols in FIG. 6 schematically show the shape of the electrode arrangement in a unit cell when seen from the front of the panel.

In the manufacturing method of the PDP according to the present invention, the thickness of the dielectric layers 3 and 5 influencing the write voltage and the height of the partitions 6 influencing the sustaining voltage can be prescribed in the same substrate process. In other words, unlike the conventional structures shown in FIGS. 16 and 18, parameters defining respective voltages do not extend over separate substrates, and they can be adjusted by using only the substrate of one side. Therefore, dispersion of the write voltage and the sustaining voltage within the panel plane and of every manufacturing lot can be made small, and their reproducibility can be also improved. In addition, since the data electrode 2 and the scan electrode 4 requiring occurrence of the write discharge 21 every unit cell can be formed on the same substrate, positioning of each electrode can be conducted with high precision. In addition, since the greater part of the manufacturing precision in the whole manufacturing process can be concentrated to a substrate of one side (which is the back glass substrate 1 in the case of FIG. 3), the manufacturing yield can be easily improved. Furthermore, since the high manufacturing precision becomes unnecessary in the process of each of the substrates, it becomes possible to reduce the manufacturing cost on the whole and improve the throughput.

In the PDP of the present invention, the write voltage can be made approximately at most the sustaining voltage by adjusting the thickness of the dielectric layers 3 and 5. In other words, in the drive method of the present invention, the write voltage is made approximately at most the sustaining voltage, unlike, for example, the conventional structures shown in FIGS. 16 and 18. As a result, the load on the drive circuits of the data electrode 2 and the scan electrode 4 is lightened, and the reliability can be improved. Furthermore, since a sufficient margin remains in the write voltage value which can be applied, it becomes possible to raise the write voltage easily and improve the write characteristics.

As the data electrode 2 and the scan electrode 4 in the structure of the present invention, electrodes each having low resistance and a high reflection factor of ultraviolet light and visible light are desirable. Because the picture quality degradation caused by the pulse delay can be suppressed, and at the same time the luminance and efficiency can be improved by reflecting the ultraviolet light and visible light to the display surface side (the front glass substrate 10 side in FIG. 3). Especially, if the resistivity is at most 10 $\mu\Omega\cdot$cm and the reflection factor of ultraviolet light to visible light is at least 80%, the electrodes are optimum. Furthermore, their structure may be a single layer, or may be multi-layered. In the case of the multi-layer structure, it is not necessary that all layers have conductivity. However, it is desirable that at least the layer of the display surface side has a high reflection factor.

As the dielectric layers 3 and 5, layers which scatter ultraviolet light and visible light are desirable. Because ultraviolet light and visible light are scattered to the display surface side and the luminance and efficiency can be improved. Furthermore, their structure may be a single layer, or may be multi-layered. In the case of the multi-layer structure, it is desirable that at least the layer of the display surface side has a light scattering property. Furthermore, the dielectric layers 3 and 5 may be formed over the whole surface of the back glass substrate 1, or may be partially formed so as to cover only the data electrode 2 and the scan electrode 4. If the dielectric layers 3 and 5 are formed over the whole surface of the back glass substrate 1, however, light can be scattered without unevenness.

Figure 9:
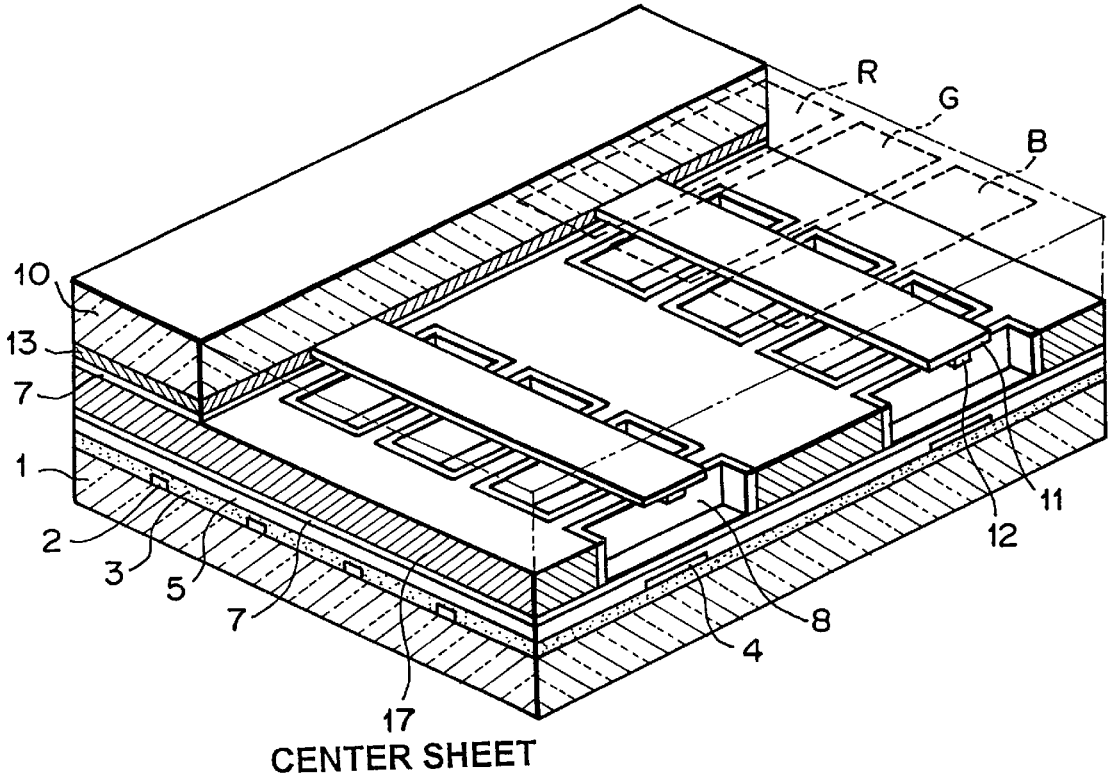
FIG. 9 is an oblique view showing a different panel structure of the present invention.

As the partitions 6, partitions capable of scattering ultraviolet light and visible light are desirable. Because ultraviolet light and visible light are scattered to the display surface side and the luminance and efficiency can be improved. Furthermore, if the permittivity of the partitions 6 is lower than that of the dielectric layers 3, 5 and 13, then it is possible to suppress the power loss caused by charging of the partition capacitance and suppress false lighting and false extinguishment between cells adjacent in the lateral direction caused by the wall charge of the partition side surfaces. Furthermore, the section shape of the partitions 6 need not be a rectangle as exemplified in FIGS. 3*a* to 3*f*, but may be nearly a trapezoid having an inclined or curved region. In this case, since the forming area of the fluorescent material layer 8 is increased, the quantity of ultraviolet light emitted from the plasma converted into visible light is increased and the luminance and efficiency can be improved. On the other hand, the plane shape of the partitions 6 is not restricted to the stripe shape as exemplified in FIG. 1. For example, if a grid-shaped partition as exemplified in FIG. 9 is used, then the fluorescent material layer 8 can be formed so as surround the inside of cells, and consequently the luminance and efficiency can be improved as compared with the case of FIG. 1. The plane shape of individual cells need not be a rectangle, but may be, for example, a square, or a polygon such as a triangle. The plane shape may also be a circle or an ellipse. If these plane shapes are combined with the above described section shape (nearly a trapezoid), then the partition structure can be made nearly three-dimensional cone-shaped and consequently the luminance and efficiency can be further improved. These partitions are not restricted to the back glass substrate 1 side. The partitions may be provided on the front glass substrate 10 side. Or the partitions may be provided on both glass substrates.

As for the partitions 6, the height also becomes an important factor besides the above described factors.

Figure 8:
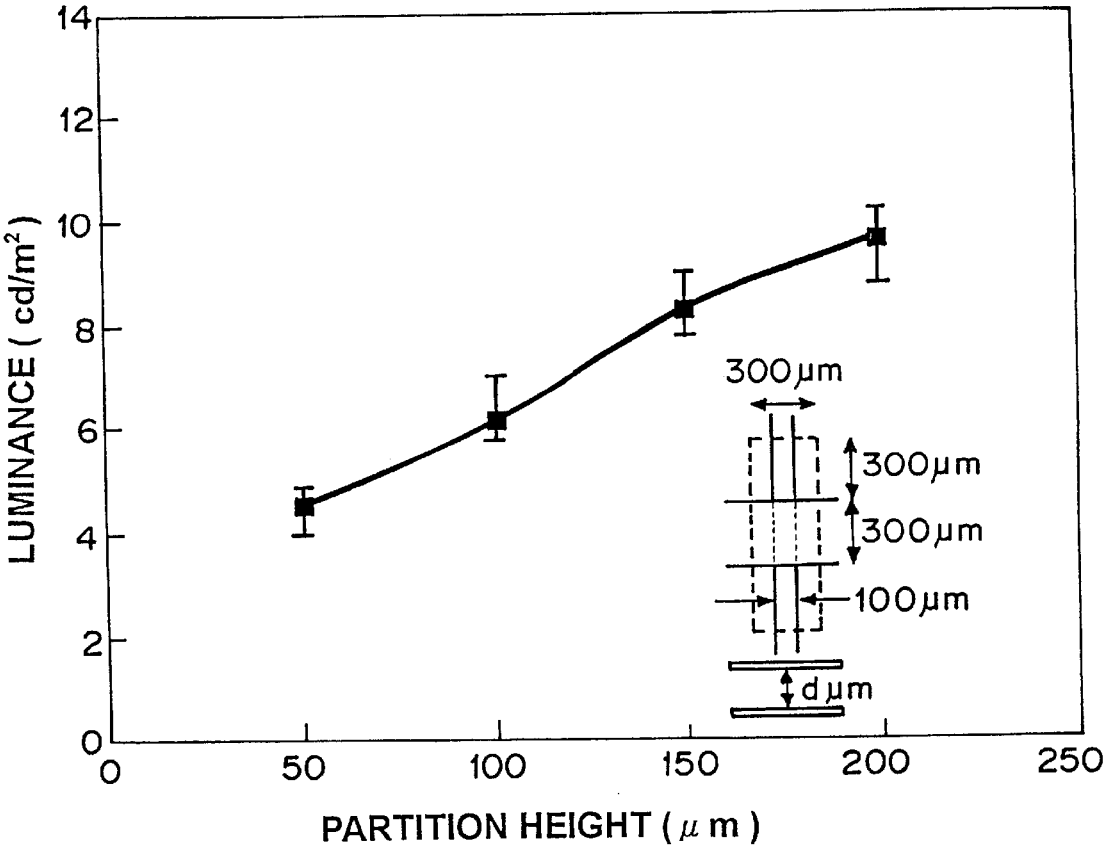
FIG. 8 is a diagram showing dependence of the luminance in a structure of the present invention upon the height of partitions.

FIG. 8 shows dependence of the luminance per kHz in the illustrated test cell upon the partition height (d). Typically, as the luminance of the display device, at least 5 cd/m$^2$, more preferably, at least 8 cd/m$^2$ is demanded. As evident from FIG. 8, if the partition height is at least 100 $\mu$m, a luminance of at least 5 cd/m$^2$ is obtained in the structure of the present invention. Especially, if the partition height is at least 150 $\mu$m, a luminance of at least 8 cd/m$^2$ is obtained.

In a PDP having a conventional structure as shown in FIG. 18, the space between the scan electrode 4 and the common electrode 11 which takes charge of the sustaining discharge 22, i.e., the discharge distance is limited by the cell size. Especially in the panel of high resolution, the discharge distance cannot help becoming short. On the other hand, in the structure of the present invention, the discharge distance is not limited by the cell size. For example, even in a panel of high resolution, therefore, the discharge distance of at least 1 mm can be implemented by increasing the height of the partitions. By utilizing such a long discharge length, it becomes possible to increase the quantity of ultraviolet light fed from a positive column region and utilize the Townsend discharge form. As a result, the luminance and efficiency can be improved dramatically. As a matter of course, it becomes necessary to increase the sustaining voltage in this case. Unlike the signal pulse 18 and the write pulse 19 which can be generated by using an IC, however, the sustaining pulse 20 is generated by using a FET (field effect transistor) and so on. Therefore, using a high voltage does not pose a great industrial problem. Furthermore, the charge-discharge power loss which becomes a problem when repetitively applying the sustaining pulse 20 is proportionate to square of the applied voltage. In the structure of the present invention, however, the sustaining discharge is the vertical discharge, unlike the case of the planar dischargetype of the conventional technique. The capacitance between the scan electrode 4 and the common electrode 11 is markedly small. Therefore, the charge-discharge power loss also becomes small. Furthermore, the electrode resistance of the scan electrode 4 and the common electrode 11 is also small, and the collection efficiency of a charge collection circuit can also be increased. Therefore, the charge-discharge power loss can be rather decreased.

As the protection layer 7, a layer which is excellent in mechanical strength and high in secondary electron emission coefficient is desirable, because the material life against ion impact is long and in addition a discharge is easy to occur. Furthermore, if the layer is nonporous, high in surface flatness, and thermally and chemically stable, the layer is suitable. In this case, excessive impurities are neither adsorbed nor changed in quality, and consequently the characteristics and reliability of the panel as a whole can be improved. In the structure of the present invention exemplified in FIG. 1, an opening portion 9 is formed in the fluorescent material layer 8 located in an intersection of the data electrode 2 and the scan electrode 4 and the protection layer 7 is exposed. In such a structure, secondary electrons are supplied from the protection layer 7, and consequently a discharge is easy to be generated and sustained. In addition, there is an advantage that degradation of the fluorescent material layer 8 caused by ion impact and voltage dispersion between cells caused by the fluorescent material layers 8 of R, G and B can be reduced. However, the fluorescent material layer 8 may be formed over the whole surface of the dielectric layer 5 inclusive of the partitions 6. The fluorescent material layer 8 may be provided on the front glass substrate 10 side, instead of the back glass substrate 1 side. Or the fluorescent material layer 8 may be provided on both glass substrates. If at this time the fluorescent material layer 8 provided on the front glass substrate 10 side has a transmission factor of such a degree as not to obstruct visible light emitted from the back glass substrate 1 side, then the luminance and efficiency can be further improved. On the other hand, the protection layer 7 may be formed so as to cover the fluorescent material layer 8. In the case where the protection layer 7 is formed so as to cover the fluorescent material layer 8, a discharge becomes easy to occur and degradation of the fluorescent material layer 8 caused by ion impact can be suppressed, even if the fluorescent material layer 8 in the region where the write discharge 21 and the sustaining discharge 22 are caused is not eliminated. However, the protection layer 7 at this time is desired to be made of a material capable of transmitting ultraviolet light. Because the quantity of ultraviolet light converted to visible light by the fluorescent material layer 8 decreases remarkably if ultraviolet light is absorbed in the protection layer 7. As a result, this remarkably lowers the luminance and efficiency. Therefore, the optical band gap of the protection layer 7 is desired to be at least 6 eV. Especially, if the optical band gap of the protection layer 7 is at least 8 eV, then up to ultraviolet light having a wavelength of at most 150 nm can be transmitted, and consequently it becomes possible to effectively utilize up to ultraviolet light emitted from noble gas atoms (He, Ne, Ar, Kr, Xe) in the excitation state.

As the common electrode 11, an electrode which is low in resistance and high in transmission factor of visible light is desirable. Because the picture quality degradation caused by the pulse delay can be suppressed, and light converted to visible light by the fluorescent material layer 8 can be efficiently taken out to the display surface side, resulting in improved luminance and efficiency. Especially, if the transmission factor of visible light is at least 80%, the electrode is suitable. In addition, in the case where each of the scan electrode 4 and the common electrode 11 takes the shape of an independent line as shown in FIG. 1, respective electrodes may be taken out from opposite sides as shown in FIG. 3. In other words, a terminal connection portion 15 of the scan electrode 4 and a terminal connection portion 16 of the common electrode 11 are provided on opposite sides. In this case, there is also an advantage in the process of the terminal connection or the like. Besides, however, there is a great advantage in the uniformity of sustaining discharge luminance.

As the bus electrode 12, it is desired to be low in resistance and low in reflection factor of visible light. Because the picture quality lowering caused by the pulse delay can be suppressed, and at the same time, contrast lowering caused by external light reflection can be suppressed. Especially, if the resistivity is at most 10 $\mu\Omega\cdot$cm and the reflection factor of visible light is at most 20%, the electrode is suitable. Furthermore, its structure may be a single layer, or may be multi-layered. In the case of the multi-layer structure, it is desirable that at least the layer of the display surface side has a low reflection factor. In FIG. 1, such a structure that the bus electrode 12 made of metal is formed above the common electrode 11 made of a transparent conductive film is exemplified. Alternatively, the bus electrode 12 may be formed under the common electrode 11. In this case, the bus electrode 12 which corrodes easily is protected by the common electrode 11 which is a chemically stable metallic oxide. Therefore, degradation such as a quality change the bus electrode 12 is subjected to because of various chemicals and water in the air can be advantageously suppressed. Furthermore, its forming position may be a central part of the common electrode 11 or an end part thereof. Furthermore, the bus electrode 12 may be formed in contact with an end surface of the common electrode 11. On the other hand, there are no restrictions on the number of bus electrodes electrically connected to the common electrode 12 and connection places. It may be single or may be plural.

As the dielectric layer 13, a layer having a high transmission factor of visible light is desirable. Because light converted to visible light by the fluorescent material layer 8 can be taken out to the display surface side efficiently, and the luminance and efficiency can be improved. Especially, if the transmission factor of visible light is at least 80%, the layer is suitable. In addition, if light is not scattered by an air bubble or unevenness of the surface, the layer is convenient. Furthermore, its structure may be a single layer structure, or may be a multilayer structure.

Besides the matters heretofore described, color filters may be provided on the front glass substrate 10 side so as to correspond to colors of R, G and B. In this case, there is an advantage that the chromaticity and contrast are improved. Furthermore, a scattering layer for reflecting ultraviolet light and visible light may be provided under the fluorescent layer 8. In this case, ultraviolet light and visible light transmitted by the fluorescent layer 8 can be reflected to the display surface side again, and consequently the luminance and efficiency can be further improved. In addition, it is possible to provide the data electrode 2 and the scan electrode 4 on the front glass substrate 10 side and the common electrode 11 made of metal on the back glass substrate side. In this case, the common electrode 11 may be opaque. As for the data electrode 2 and the scan electrode 4 formed on the display surface side, however, at least a part thereof is desired to be transparent and conductive. Therefore, each of the data electrode 2 and the scan electrode 4 is formed of a transparent conductive film and a bus electrode made of metal. In this case, lowering of the aperture factor of cells can be prevented. As a result, lowering of the luminance and efficiency can be suppressed. As a matter of course, it is possible to form every electrode of only metal in this case as well.

Furthermore, polarities of respective voltage pulses shown in FIG. 4 may be inverted. The waveform and timing of the voltage pulses are not restricted so long as the voltage pulses are capable of sufficiently causing the write discharge 21 and the sustaining discharge 22.

Embodiment 2

Figure 10:
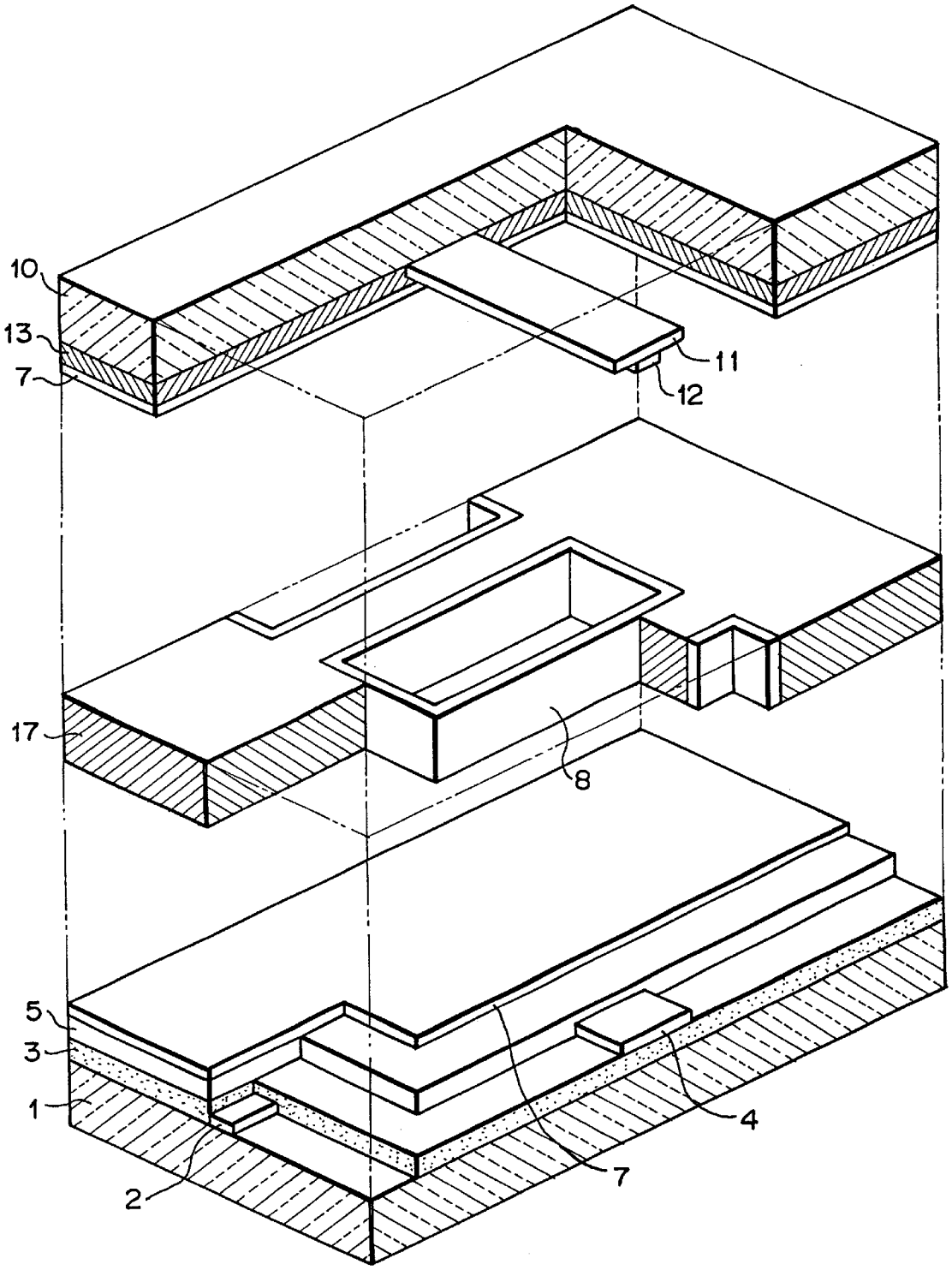
FIG. 10 is an oblique exploded view showing a different unit cell structure of the present invention.

FIG. 9 is an oblique view of another PDP according to the present invention. Furthermore, FIG. 10 is an exploded oblique view showing its unit cell structure. Unlike the embodiment 1, the embodiment 2 is not formed of two pieces, i.e., the front glass substrate 10 and the back glass substrate 1, but formed of three pieces including a center sheet 17 interposed between the front glass substrate 10 and the back glass substrate 1. By referring to FIGS. 9 and 10, a different structure of the present invention will be described. On the back glass substrate 1, data electrodes 2 made of metal or the like are formed in the substrate column direction. Over the data electrodes 2, a dielectric layer 3 made of a metallic oxide or the like is formed. On the dielectric layer 3, scan electrodes 4 made of metal or the like are formed in a substrate row direction. Over the scan electrodes 4, a dielectric layer 5 made of a metallic oxide or the like and a protection layer 7 are formed.

On the other hand, on the front glass substrate 10, transparent conductive common electrodes 11 made of a metallic oxide or the like and bus electrodes 12 electrically connected to the common electrodes 11 and made of metal or the like are formed in the substrate row direction so as to be opposed to the scan electrodes 4. Over the common electrodes 11 and the bus electrodes 12, a dielectric layer 13 made of a metallic oxide or the like and a protection layer 7 are formed.

Between the front glass substrate 10 and the back glass substrate 1, opening portions, which are made of a metallic oxide, for example, such as ceramics or glass, and which are capable of partitioning cells of R, G and B, and a center sheet 17 having fluorescent material layers 8 in the opening portions are interposed. The front glass substrate 10 and the back glass substrate 1 are stuck together so as to have their structures inside via the center sheet 17 by using frit glass seal or the like for hermetic seal. Within space thus formed, gas for a discharge containing noble gas or the like is let in. R, G and B in FIG. 1 represent a red color luminous unit cell, a green luminous unit cell, and a blue luminous unit cell for coloring, respectively.

Figure 11A:
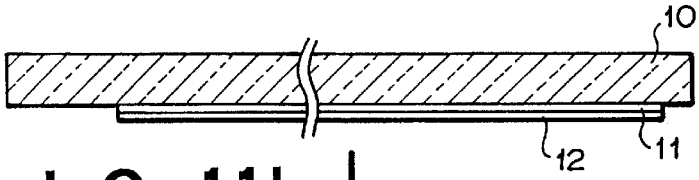
FIGS. 11*a* to 11*f* are sectional views showing a different manufacturing method of the present invention.

FIGS. 11*a* to 11*f* are sectional views showing manufacturing processes of the different PDP according to the present invention. First, a process of the front glass substrate 10 side will now be described. First of all, a common electrode 11 is formed on the front glass substrate 10 by using the coating method, the printing method, the photosensitive resin method, the vacuum film forming method, the plating method, the writing method, or the like. Thereafter, the bus electrode 12 is formed on the common electrode 11 by using the coating method, the printing method, the photosensitive resin method, the vacuum film forming method, the plating method, the writing method, or the like (FIG. 11*a*).

Figure 11B:
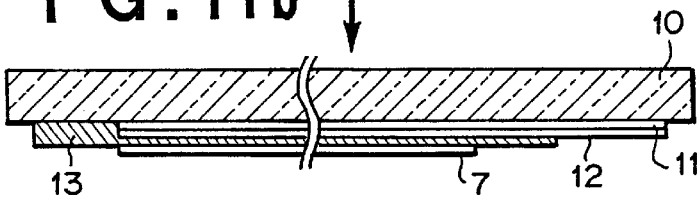

Subsequently, on the common electrode 11 and the bus electrode 12, the dielectric layer 13 is formed by using the coating method, the printing method, the photosensitive resin method, the vacuum film forming method, or the like. Thereafter, the protection layer 7 is formed on the dielectric layer 13 by using the vacuum evaporation method, the coating method, or the like (FIG. 11*b*).

Figure 11E:
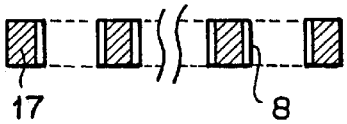
Figure 11F:
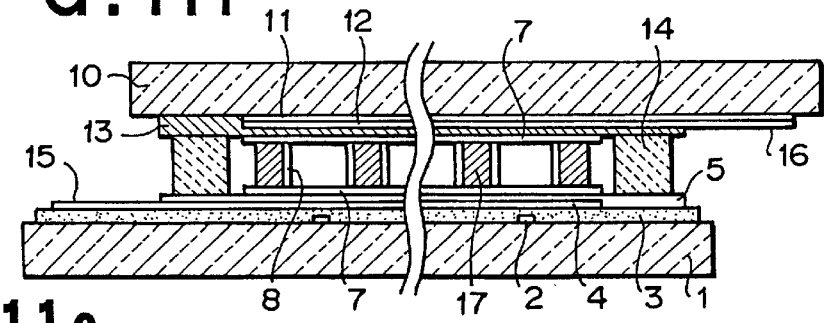
Figure 11C:
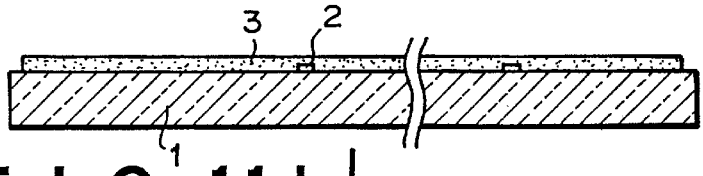

Subsequently, a process of the back glass substrate 1 side will now be described. First, the data electrodes 2 are formed on the back glass substrate 1 by using the printing method, the photosensitive resin method, the vacuum film forming method, the plating method, the writing method, or the like. Thereafter, the dielectric layer 3 is formed on the data electrodes 2 by using the coating method, the printing method, the photosensitive resin method, the vacuum film forming method, or the like (FIG. 11*c*).

Figure 11D:
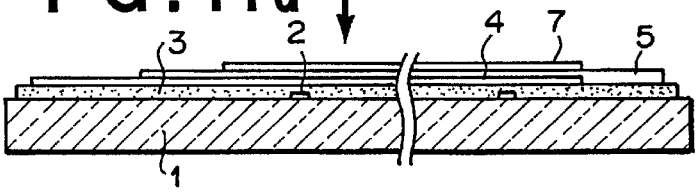

Subsequently, the scan electrodes 4 are formed on the dielectric layer 3 by using the printing method, the photosensitive resin method, the vacuum film forming method, the plating method, the writing method, or the like. Thereafter, the dielectric layer 5 is formed on the scan electrodes 4 by using the coating method, the printing method, the photosensitive resin method, the vacuum film forming method, or the like. On the dielectric layer 5, the protection layer 7 is formed by using the vacuum film forming method, the coating method, or the like (FIG. 11*d*).

Subsequently, a process of the center sheet 17 side will now be described. As for the center sheet 17, a ceramic sheet or a glass sheet having the opening portions corresponding to cells of R, G and B formed collectively beforehand may be used. In this case, the fluorescent material layers 8 for red color light emission, green color light emission, and blue color light emission corresponding to R, G and B are formed in holeshaped or groove-shaped opening portions by using the printing method, the photosensitive resin method, the writing method, or the like. Alternatively, the opening portions may be provided afterwards. In this case, respective fluorescent material layers 8 are formed in the opening portions (FIG. 11*e*).

Subsequently, a panel assembling process will now be described. First of all, the center sheet 17 is disposed on either the front glass substrate 10 or the back glass substrate 1.

Subsequently, flit glass seal or the like is provided on a substrate fringe portion of either the front glass substrate 10 or the back glass substrate 1. The front glass substrate 10 and the back glass substrate 1 are stuck together so as to oppose the scan electrodes 4 to common electrodes 11 paired therewith, respectively, and the substrates are hermetically sealed.

Subsequently, via a gas exhaust and gas intake pipe provided in the panel peripheral portion, residual impurities (such as organic matters) within the panel are removed by baking, discharge cleaning, or the like. Thereafter, vacuum evacuation of the inside of the panel is conducted.

Finally, noble gas for a discharge is let in from the pipe, and the pipe is hermetically sealed. The panel manufacturing process is finished (FIG. 11*f*).

The duty of the center sheet 17 is the same as the partitions 6 of the embodiment 1. Therefore, it is a matter of course that the materials and conditions mentioned as suitable for the partitions 6 in the foregoing description of the embodiment 1 hold true of the center sheet 17 as well.

By using the center sheet 17, the manufacturing process after the protection layer 7 formed on the back glass substrate 1 side (process for forming the fluorescent material layers 8) can be omitted, unlike the foregoing embodiment 1. Therefore, there is especially an advantage that the characteristics degradation of the protection layer 7 formed on the back glass substrate 1 side in the subsequent manufacturing process can be suppressed.

In addition, the process for forming the partitions and the fluorescent material layers which is the most important and difficult in the PDP manufacturing process can be separated from the glass substrates and can be manufactured in a dedicated process. As a result, it also becomes possible to improve the manufacture yield of the panel as a whole.

Embodiment 3

Figure 12:
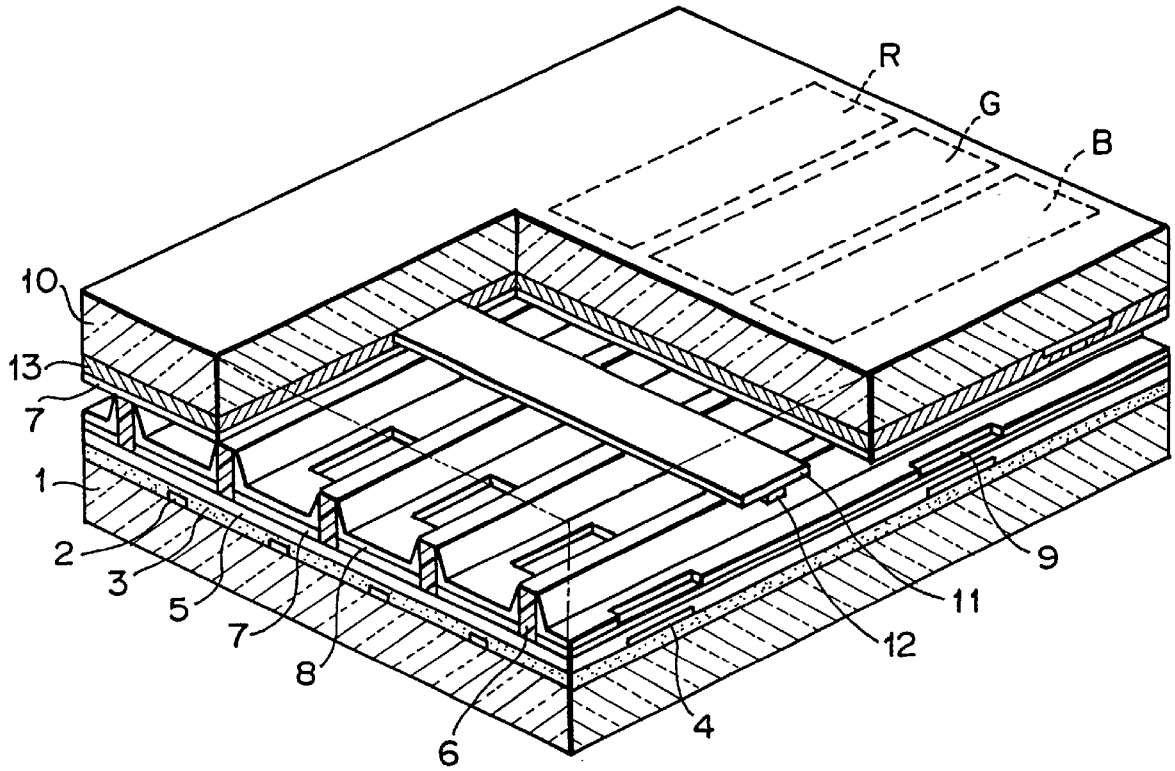
FIG. 12 is an oblique view showing a different panel structure of the present invention.
Figure 13:
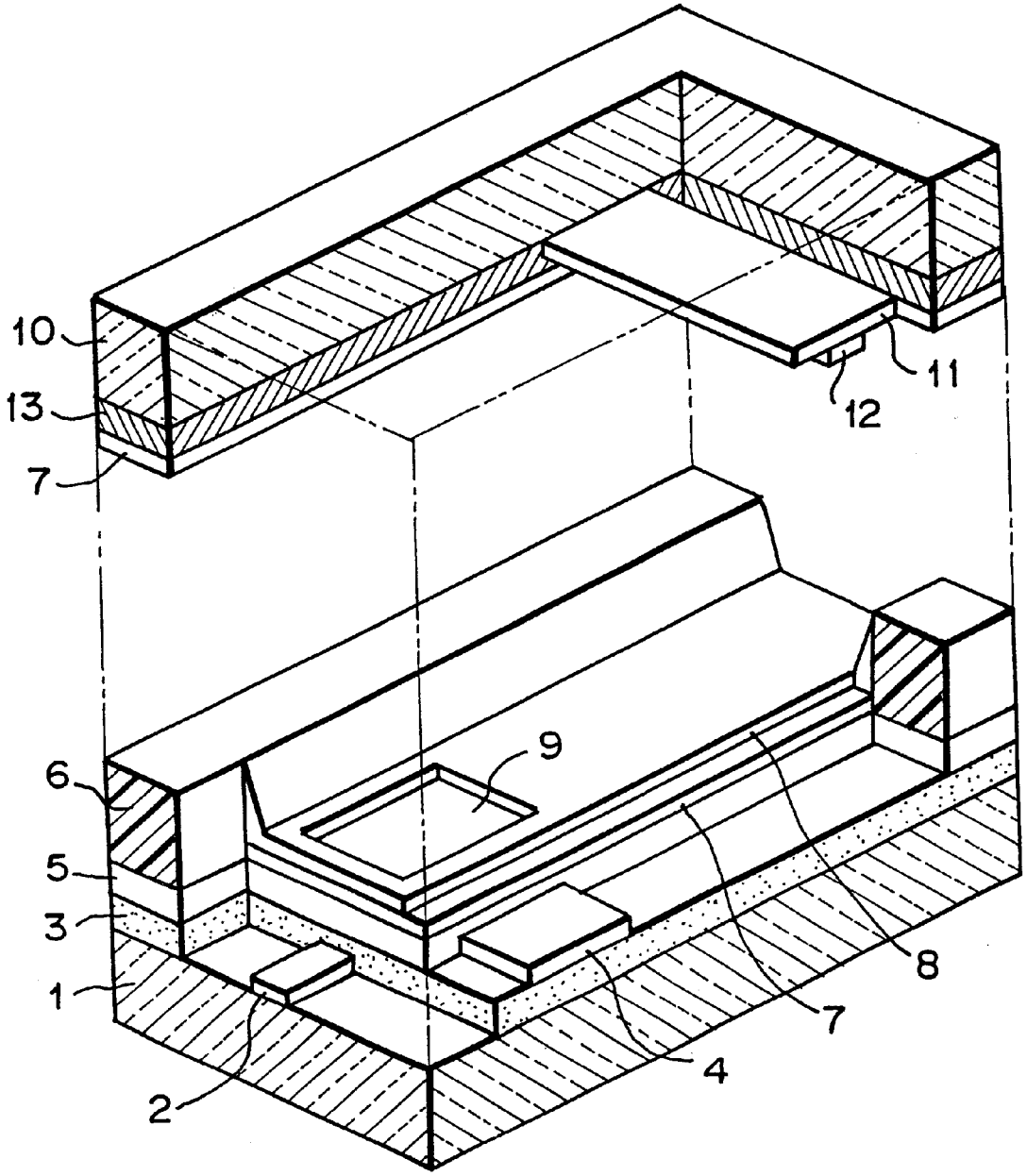
FIG. 13 is an oblique exploded view showing a different unit cell structure of the present invention.

FIG. 12 is an oblique view of a different PDP according to the present invention. FIG. 13 is an oblique exploded view showing a unit cell structure. Unlike the embodiment 1 and the embodiment 2, in the embodiment 3, a common electrode 11 formed on the front glass substrate 10 side and a scan electrode 4 formed on the back glass substrate 1 side are not located in such positions that they are just opposed to each other. The common electrode 11 is formed with a shift in the cell longitudinal direction from the scan electrode 4. As for the structure of the present invention, the case where the PDP is manufactured by using the manufacturing method described with reference to the embodiment 1 is exemplified.

In the structure of the present invention, a sustaining discharge 22 is generated obliquely between the scan electrode 4 and the common electrode 11. Therefore, the sustaining discharge 22 looks as if it extends in the cell longitudinal direction. Even if the height of the partitions 6 is the same, therefore, the effective discharge length is prolonged. Accordingly, the discharge region is expanded. As a result, the quantity of emitted light is increased. In addition, ultraviolet light is applied to the fluorescent material layer 8 over a wide area. As compared with the structure of FIG. 1, therefore, the luminance and efficiency can be improved.

Figure 14:
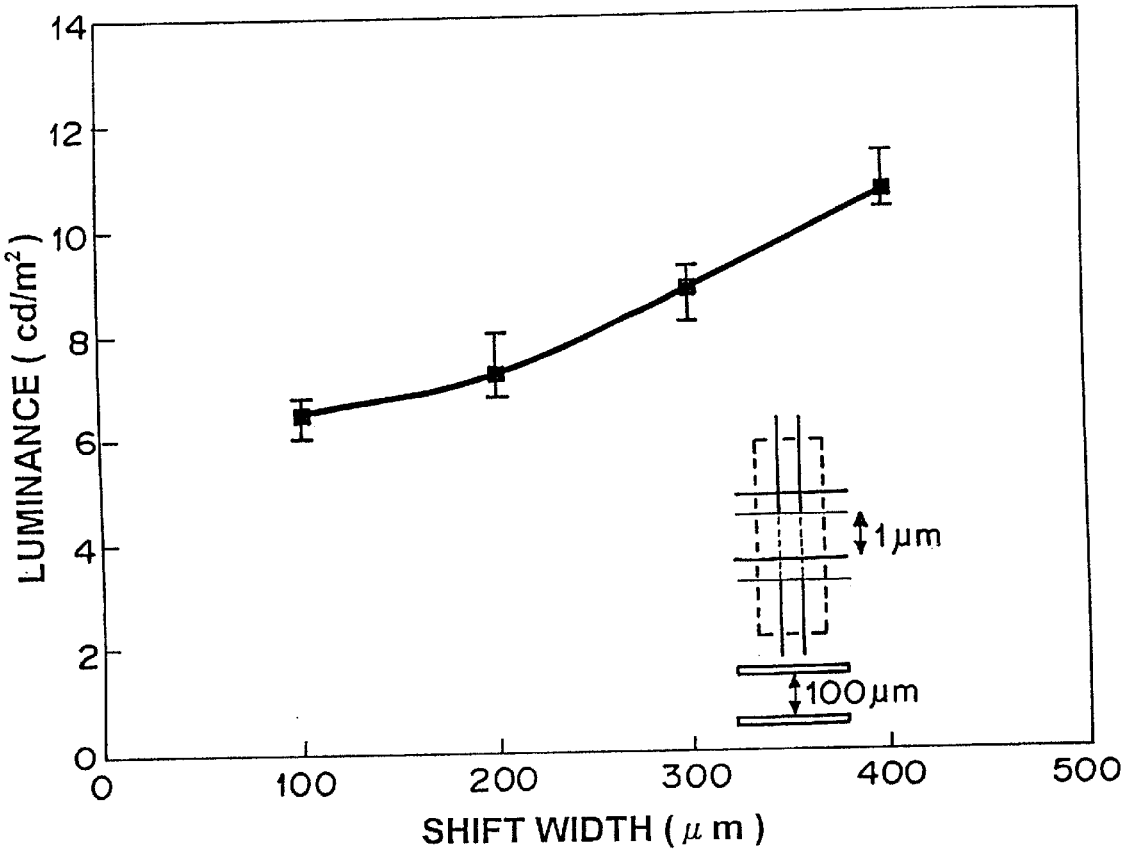
FIG. 14 is a diagram showing dependence of the luminance in a different structure of the present invention upon the electrode shift width.

FIG. 14 shows dependence of luminance per kHz in a test cell shown in FIG. 14 upon a shift width (1) between the scan electrode 4 and the common electrode 11. Other dimensions of the test cell are the same as those of FIG. 8. In the structure of the present invention, the luminance is increased if the shift width is at least half of the electrode width, as evident from FIG. 14. Especially, if the shift width is at least the electrode width, the luminance is improved significantly. Although only data for a shift width of up to 400 $\mu$m are shown in FIG. 14, the shift width is not limited to this. For example, if the shift width is made at least 1 mm, the sustaining voltage rises, but the quantity of ultraviolet light from the discharge region, or especially from the positive column region increases. Therefore, the luminance and efficiency can be improved.

Besides the matters heretofore described, it is a matter of course that the materials and conditions mentioned as suitable for the foregoing embodiments hold true of the structure of the present invention as well.

In Japanese Patent Application Laid-Open Publication Hei-4-181633, there is disclosed a PDP including a back substrate having a data electrode and a scan electrode formed via an insulating material layer so as to be perpendicular to each other and a first dielectric layer formed on the data electrode and the scan electrode, and a front substrate having a transparent electrode covered by a second dielectric layer. Unlike the present invention, the PDP is intended for a panel for monochromatic image display containing Ne gas or the like and having neither partitions nor fluorescent materials. In the drive as well, the PDP is intended for a PDP of refresh type AC system having no memory effects. Accordingly, the operation and effects of the present invention described above are not obtained.

As heretofore described, the PDP of the present invention is excellent in display performance and life characteristics, and has a great industrial value especially as a PDP implementing a large screen display such as a wall type television set.

What is claimed is:

1. A plasma display panel (PDP) having a first substrate and a second substrate which are opposed to each other, and displaying color image by accelerating electrons with an electric field, causing the electrons to collide with gas, and converting generated ultraviolet light to visible light by fluorescent materials, which comprises:

a plurality of data electrodes disposed on said first substrate in a column direction;

a plurality of scan electrodes disposed on said first substrate in a row direction perpendicular to said column direction;

a plurality of common electrodes disposed on said second substrate in a row direction in parallel to said scan electrodes;

a plurality of fluorescent layers, each of which emits either of red (R), green (G), or blue (B) light; and a sheet having a plurality of apertures which is disposed between said first and second substrates, wherein the walls of said apertures are covered by said fluorescent layers, wherein:

a first dielectric layer is disposed on said data electrodes on said-first substrate;

said scan electrodes are disposed on said first dielectric layer;

a second dielectric layer is disposed on said scan electrodes;

a third dielectric layer is disposed on said common electrodes on said second substrate, wherein:

a sheet having a plurality of apertures is disposed between said first and second substrates; and the walls of said apertures are covered by said fluorescent layers.

2. The PDP according to claim 1, wherein the walls of said apertures are inclined partly with respect to the normal of said first and second substrate.

3. The PDP according to claim 1, wherein the planar shape of said apertures for discharges is partly an n-sided polygon ($n \geqq 3$) or a curved shape.

4. The PDP according to claim 1, wherein the thickness of said sheet is in the range of 150 $\mu$m to 10 mm.

5. The PDP according to claim 1, wherein said common electrodes comprises transparent electrodes and metal bus electrodes.

6. The PDP according to claim 1, wherein said data electrodes and/or said scan electrodes comprise transparent electrodes and metal bus electrodes.

7. The PDP according to claim 1, wherein said common electrodes, said data electrodes, and said scan electrodes are metal electrodes.

8. The PDP according to claim 1, wherein said scan electrodes and said common electrodes are formed in the same position via a discharge space.

9. The PDP according to claim 1, wherein said scan electrodes and said common electrodes are formed in the different position via a discharge space.

10. The PDP according to claim 1, wherein said scan electrodes are shifted in their positions from said common electrodes by an amount which is larger than a width of either said scan electrodes or said common electrodes.

11. A method of manufacturing a plasma display panel (PDP) having a first substrate and a second substrate which are opposed to each other, and displaying color image by accelerating electrons with an electric field, causing the electrons to collide with gas, and converting generated ultraviolet light to visible light by fluorescent materials, which comprises:

a plurality of data electrodes disposed on said first substrate in a column direction;

a plurality of scan electrodes disposed on said first substrate in a row direction perpendicular to said column direction;

a plurality of common electrodes disposed on said second substrate in a row direction in parallel to said scan electrodes;

a plurality of fluorescent layers, each of which emits either of red (R), green (G), or blue (B) light; and a plurality of partitions for partitioning said fluorescent layers, thereby forming a plurality of spaces for discharges by said electrons and said gas, which comprises the steps of:

forming a plurality of said data electrodes on said first substrate;

forming a first dielectric layer on said data electrodes;

forming a plurality of said scan electrodes on said first dielectric layer;

forming a second dielectric layer on said scan electrodes;

forming said partitions on said second dielectric layer;

forming said fluorescent layers on said partions and on said second dielectric layer;

forming a plurality of said common electrodes on said second substrate; and forming a third dielectric layer on said common electrodes.

12. A method for manufacturing a plasma display panel (PDP) having a first substrate and a second substrate which are opposed to each other, and displaying color image by accelerating electrons with an electric field, causing the electrons to collide with gas, and converting generated ultraviolet light to visible light by fluorescent materials, which comprises:

a plurality of data electrodes disposed on said first substrate in a column direction;

a plurality of scan electrodes disposed on said first substrate in a row direction perpendicular to said column direction;

a plurality of common electrodes disposed on said second substrate in a row direction in parallel to said scan electrodes;

a plurality of fluorescent layers, each of which emits either of red (R), green (G), or blue (B) light; and a plurality of partitions for partitioning said fluorescent layers, thereby forming a plurality of spaces for discharges by said electrons and said gas, which comprises the steps of:

forming a plurality of said data electrodes on said first substrate;

forming a first dielectric layer on said data electrodes;

forming a plurality of said scan electrodes on said first dielectric layer;

forming a second dielectric layer on said scan electrodes;

forming a plurality of said common electrodes on said second substrate;

forming a third dielectric layer on said common electrodes;

forming said partitions on said third dielectric layer; and forming said fluorescent layers on said partions and on said third dielectric layer.

13. A method of manufacturing a plasma display panel (PDP) having a first substrate and a second substrate which are opposed to each other, and displaying color image by accelerating electrons with an electric field, causing the electrons to collide with gas, and converting generated ultraviolet light to visible light by fluorescent materials, which comprises:

a plurality of data electrodes disposed on said first substrate in a column direction;

a plurality of scan electrodes disposed on said first substrate in a row direction perpendicular to said column direction;

a plurality of common electrodes disposed on said second substrate in a row direction in parallel to said scan electrodes;

a plurality of fluorescent layers, each of which emits either of red (R), green (G), or blue (B) light; and a sheet having a plurality of apertures which is disposed between said first and second substrates,wherein the walls of said apertures are covered by said fluorescent layers, wherein:

a first dielectric layer is disposed on said data electrodes on said first substrate;

said scan electrodes are disposed on said first dielectric layer;

a second dielectric layer is disposed on said scan electrodes;

a third dielectric layer is disposed on said common electrodes on said second substrate, which comprises the steps of:

forming a plurality of said data electrodes on said first substrate;

forming a first dielectric layer on said data electrodes;

forming a plurality of said scan electrodes on said first dielectric layer;

forming a second dielectric layer on said scan electrodes;

forming a plurality of said common electrodes on said second substrate;

forming a third dielectric layer on said common electrodes; and disposing said sheet between said first substrate and said second substrate.

14. A plasma display panel (PDP) having a first substrate and a second substrate which are opposed to each other, and displaying color image by accelerating electrons with an electric field, causing the electrons to collide with gas, and converting generated ultraviolet light to visible light by fluorescent materials, which comprises:

a plurality of data electrodes disposed on said first substrate in a column direction;

a plurality of scan electrodes disposed on said first substrate in a row direction perpendicular to said column direction;

a plurality of common electrodes disposed on said second substrate in a row direction in parallel to said scan electrodes;

a plurality of fluorescent layers, each of which emits either of red (R), green (G), or blue (B) light;

a plurality of partitions for partitioning said fluorescent layers, thereby forming a plurality of spaces for discharges by said electrons and said gas;

a first dielectric layer disposed on said data electrodes on said first substrate;

said scan electrodes being disposed on said first dielectric layer;

a second dielectric layer disposed on said scan electrodes;

said partitions being disposed on said second dielectric layer;

said fluorescent layers being disposed on said partitions and on said second dielectric layer; and a third dielectric layer disposed on said common electrodes on said second substrate.

15. The PDP according to claim 14, wherein the walls of said partitions are inclined partly with respect to the normal of said first and second substrate.

16. The PDP according to claim 14, wherein the planar shape of said spaces for discharges is partly an n-sided polygon ($n \geqq 3$) or a curved shape.

17. The PDP according to claim 14, wherein the height of said partitions is in the range of 150 $\mu$m to 10 mm.

18. The PDP according to claim 14, wherein said common electrodes comprises transparent electrodes and metal bus electrodes.

19. The PDP according to claim 14, wherein said data electrodes and/or said scan electrodes comprise transparent electrodes and metal bus electrodes.

20. The PDP according to claim 14, wherein said common electrodes, said data electrodes, and said scan electrodes are metal electrodes.

21. The PDP according to claim 14, wherein:

said first substrate and said second substrate form a panel;

a terminal connection portion for taking out said scan electrodes is provided on a certain side of said panel; and another terminal connection portion for taking out said common electrodes is provided on another side of said panel which is opposite to said certain side.

22. The PDP according to claim 14, wherein:

said first substrate and said second substrate form a panel;

a terminal connection portion for taking out said scan electrodes is provided on a certain side of said panel; and another terminal connection portion for taking out said common electrodes is provided on another side of said panel which is opposite to said certain side.

23. The PDP according to claim 14, wherein said scan electrodes and said common electrodes are formed in the same position via a discharge space.

24. The PDP according to claim 14, wherein said scan electrodes and said common electrodes are formed in the different position via a discharge space.

25. The PDP according to claim 14, wherein said scan electrodes are shifted in their positions from said common electrodes by an amount which is larger than a width of either said scan electrodes or said common electrodes.

26. A plasma display panel (PDP) having a first substrate and a second substrate which are opposed to each other, and displaying color image by accelerating electrons with an electric field, causing the electrons to collide with gas, and converting generated ultraviolet light to visible light by fluorescent materials, which comprises:

a plurality of data electrodes disposed on said first substrate in a column direction;

a plurality of scan electrodes disposed on said first substrate in a row direction perpendicular to said column direction;

a plurality of common electrodes disposed on said second substrate in a row direction in parallel to said scan electrodes;

a plurality of fluorescent layers, each of which emits either of red (R), green (G), or blue (B) light;

a plurality of partitions for partitioning said fluorescent layers, thereby forming a plurality of spaces for discharges by said electrons and said gas;

a first dielectric layer disposed on said data electrodes on said first substrate;

said scan electrodes being disposed on said first dielectric layer;

a second dielectric layer disposed on said scan electrodes;

a third dielectric layer disposed on said common electrodes on said second substrate;

said partitions being disposed on said third dielectric layer; and said fluorescent layers being disposed on said partitions and on said third dielectric layer.

27. The PDP according to claim 26, wherein the walls of said partitions are inclined partly with respect to the normal of said first and second substrate.

28. The PDP according to claim 26, wherein the planar shape of said spaces for discharges is partly an n-sided polygon ($n \geqq 3$) or a curved shape.

29. The PDP according to claim 26, wherein the height of said partitions is in the range of 150 $\mu$m to 10 mm.

30. The PDP according to claim 26, wherein said common electrodes comprises transparent electrodes and metal bus electrodes.

31. The PDP according to claim 26, wherein said data electrodes and/or said scan electrodes comprise transparent electrodes and metal bus electrodes.

32. The PDP according to claim 26, wherein said common electrodes, said data electrodes, and said scan electrodes are metal electrodes.

33. The PDP according to claim 26, wherein:

said first substrate and said second substrate form a panel;

a terminal connection portion for taking out said scan electrodes is provided on a certain side of said panel; and another terminal connection portion for taking out said common electrodes is provided on another side of said panel which is opposite to said certain side.

34. The PDP according to claim 26, wherein:

said first substrate and said second substrate form a panel;

a terminal connection portion for taking out said scan electrodes is provided on a certain side of said panel; and another terminal connection portion for taking out said common electrodes is provided on another side of said panel which is opposite to said certain side.

35. The PDP according to claim 26, wherein said scan electrodes and said common electrodes are formed in the same position via a discharge space.

36. The PDP according to claim 26, wherein said scan electrodes and said common electrodes are formed in the different position via a discharge space.

37. The PDP according to claim 26, wherein said scan electrodes are shifted in their positions from said common electrodes by an amount which is larger than a width of either said scan electrodes or said common electrodes.

38. A method of driving a plasma display panel (PDP) having a first substrate and a second substrate which are opposed to each other, and displaying color image by accelerating electrons with an electric field, causing the electrons to collide with gas, and converting generated ultraviolet light to visible light by fluorescent materials, which comprises:

a plurality of data electrodes disposed on said first substrate in a column direction;

a plurality of scan electrodes disposed on said first substrate in a row direction perpendicular to said column direction; and a plurality of common electrodes disposed on said second substrate in a row direction in parallel to said scan electrodes, which comprises the steps of:

a write step of applying a signal voltage pulse and a write voltage pulse having the same timing and opposite polarities to said data electrodes and said scan electrodes, respectively, for generating write discharges in selected pixels; and a sustaining step of applying sustaining voltage pulses having different timings and the same polarity to said scan electrodes and said common electrodes, respectively, for generating sustaining discharges in selected pixels, wherein $(|Vd|+|Vw|)<|Vsc|$, where $|Vd|$ is an absolute value of a peak value Vd of said signal voltage pulse, $|Vw|$ is an absolute value of a peak value Vw of said write voltage pulse, and $|Vsc|$ is an absolute value of a peak value Vsc of said sustaining voltage pulse applied to said common electrodes.

39. A drive method of plasma display panel according to claim 38, wherein said write discharge is a planar discharge and said sustaining discharger is a vertical discharge.

40. A method of driving a plasma display panel (PDP) having a first substrate and a second substrate which are opposed to each other, and displaying color image by accelerating electrons with an electric field, causing the electrons to collide with gas, and converting generated ultraviolet light to visible light by fluorescent materials, which comprises:

a plurality of data electrodes disposed on said first substrate in a column direction;

a plurality of scan electrodes disposed on said first substrate in a row direction perpendicular to said column direction; and a plurality of common electrodes disposed on said second substrate in a row direction in parallel to said scan electrodes, which comprises the steps of:

a write step of applying a signal voltage pulse and a write voltage pulse having the same timing and opposite polarities to said data electrodes and said scan electrodes, respectively, for generating write discharges in selected pixels; and a sustaining step of applying bipolar sustaining voltage pulses to common electrodes, for generating sustaining discharges in selected pixels, wherein $(|Vd|+|Vw|)<|Vs|$, where $|Vd|$ is an absolute value of a peak value Vd of said signal voltage pulse, $|Vw|$ is an absolute value of a peak value Vw of said write voltage pulse, and $|Vs|$ is an absolute value of larger one of an absolute value of a positive polarity side peak value or an absolute value of a negative polarity side peak value, of said bipolar sustaining voltage pulses.

41. A drive method of plasma display panel according to claim 40, wherein said write discharge is a planar discharge and said sustaining discharge is a vertical discharge.

* * * * *